US005816649A

United States Patent [19]

Shields

[11] Patent Number: 5,816,649

[45] Date of Patent: Oct. 6, 1998

[54] CHAIR WITH ARTICULATING TABLET AND INTERFACING TABLE

[75] Inventor: Michael R. Shields, Greensboro, N.C.

[73] Assignee: Steelcase Inc., Grand Rapids, Mich.

[21] Appl. No.: 749,146

[22] Filed: Nov. 14, 1996

[51] Int. Cl.[6] ..... A47B 39/00

[52] U.S. Cl. ..... 297/162; 297/161; 297/188.08; 297/344.21; 297/440.1

[58] Field of Search ..... 297/440.1, 135, 297/160, 161, 162, 173, 174, 344.21, 188.08, 452.65, 451.13, 344.22, 344.26; 312/235.2, 235.5, 235.9; 108/50.11, 180, 153.1, 157.1

[56] References Cited

U.S. PATENT DOCUMENTS

| | | |
|---|---|---|
| D. 044,441 | 8/1913 | Frazer . |
| D. 102,971 | 1/1937 | Hale . |
| D. 167,595 | 8/1952 | Simmons . |
| 171,528 | 12/1875 | Musser . |
| 175,176 | 3/1876 | Sheldon . |
| D. 179,593 | 1/1957 | Cramer . |
| D. 192,115 | 1/1962 | Ziegenfuss . |
| D. 207,643 | 5/1967 | Tincher . |
| D. 225,932 | 1/1973 | Duern et al. . |
| D. 226,793 | 5/1973 | Watamura . |
| 258,354 | 5/1882 | Bell . |
| D. 268,550 | 4/1983 | Coggin . |
| D. 298,196 | 10/1988 | Cionini . |
| D. 316,639 | 5/1991 | Adler . |
| D. 323,263 | 1/1992 | Blackburn . |
| 533,032 | 1/1895 | Breed . |
| 609,592 | 8/1898 | Schultz . |
| 854,298 | 5/1907 | Matthews . |
| 939,623 | 11/1909 | Payne . |
| 951,145 | 3/1910 | McGenniss . |
| 1,324,503 | 12/1919 | Hirsch . |
| 1,391,222 | 9/1921 | Van Fleet . |
| 1,634,929 | 7/1927 | Blitz et al. . |
| 1,648,717 | 11/1927 | Blitz et al. . |
| 1,659,572 | 2/1928 | Klemm . |
| 1,756,210 | 4/1930 | Racz . |
| 1,888,478 | 11/1932 | Steidl . |
| 2,619,396 | 11/1952 | Fires . |
| 2,671,631 | 3/1954 | Fox . |
| 2,746,526 | 5/1956 | Loeschnigg et al. . |
| 2,765,025 | 10/1956 | Bakalic et al. . |
| 3,029,106 | 4/1962 | McGuire . |
| 3,086,818 | 4/1963 | Panton . |
| 3,179,071 | 4/1965 | Johnston . |
| 3,361,508 | 1/1968 | Chassevent . |
| 3,408,104 | 10/1968 | Raynes . |
| 3,441,310 | 4/1969 | Gale . |
| 3,479,084 | 11/1969 | Van Ryn . |

(List continued on next page.)

*Primary Examiner*—Milton Nelson, Jr.
*Attorney, Agent, or Firm*—Price, Heneveld, Cooper, DeWitt & Litton

[57] ABSTRACT

A furniture system includes a chair with an articulatable tablet, and a table adapted to interface with the tablet. The chair tablet is supported by a support arm for articulated movement between a plurality of use positions in front of the chair, a side position generally beside the chair, and a vertical storage position generally below the side position and adjacent the chair. A latch attached to the tablet is configured to operate substantially only when the tablet is in the side position for releasing the tablet from the side position to the vertical storage position. The chair includes a seat assembly, a base including a castor-supporting frame, and a pivot for rotably supporting the seat assembly on the base. A table includes a base adapted to stably engage a floor, and a table top. A gas-spring-operated lift assist is operably connected to the base and the table top for selectively lifting/lowering the table top. An actuator button positioned in a center of the table top can be operated by one hand to raise or lower the table top. The chair tablet has an edge configured to abut and interface with a perimeter section of the table top. The chair is horizontally moveable and rotatable to facilitate positioning the chair proximate the table, so that it can be manipulated to flexibly arrange a work surface with the size and shape desired.

24 Claims, 19 Drawing Sheets

U.S. PATENT DOCUMENTS

| | | |
|---|---|---|
| 3,572,831 | 3/1971 | Barecki et al. . |
| 3,593,669 | 7/1971 | Zimmerly . |
| 3,632,161 | 1/1972 | Arfaras et al. . |
| 4,094,256 | 6/1978 | Holper et al. . |
| 4,169,625 | 10/1979 | Petersen . |
| 4,303,018 | 12/1981 | Lehmann . |
| 4,321,875 | 3/1982 | Danko . |
| 4,389,946 | 6/1983 | Hwang . |
| 4,408,543 | 10/1983 | Griffin . |
| 4,428,305 | 1/1984 | Creske . |
| 4,500,150 | 2/1985 | Leibensperger et al. . |
| 4,574,709 | 3/1986 | Lackey et al. . |
| 4,591,206 | 5/1986 | Pribble . |
| 4,654,756 | 3/1987 | Wilson et al. . |
| 4,852,940 | 8/1989 | Kanigowski . |
| 4,861,102 | 8/1989 | Fuller . |
| 4,901,998 | 2/1990 | Griffith . |
| 4,944,552 | 7/1990 | Harris . |
| 5,044,587 | 9/1991 | Degen . |
| 5,065,832 | 11/1991 | Mark . |
| 5,169,210 | 12/1992 | Fricano . |
| 5,231,562 | 7/1993 | Pierce et al. . |
| 5,237,935 | 8/1993 | Newhouse et al. . |
| 5,243,921 | 9/1993 | Kruse et al. . |
| 5,282,671 | 2/1994 | Funk . |
| 5,353,716 | 10/1994 | Wilbert . |
| 5,380,064 | 1/1995 | Yamano et al. . |
| 5,421,271 | 6/1995 | Sui . |
| 5,451,092 | 9/1995 | Gray . |
| 5,485,795 | 1/1996 | Williams . |
| 5,490,710 | 2/1996 | Dearing et al. . |

Fig. 18B
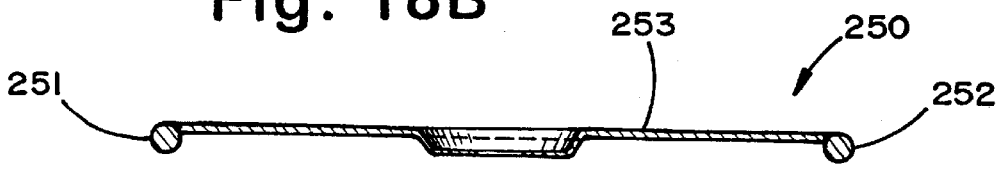
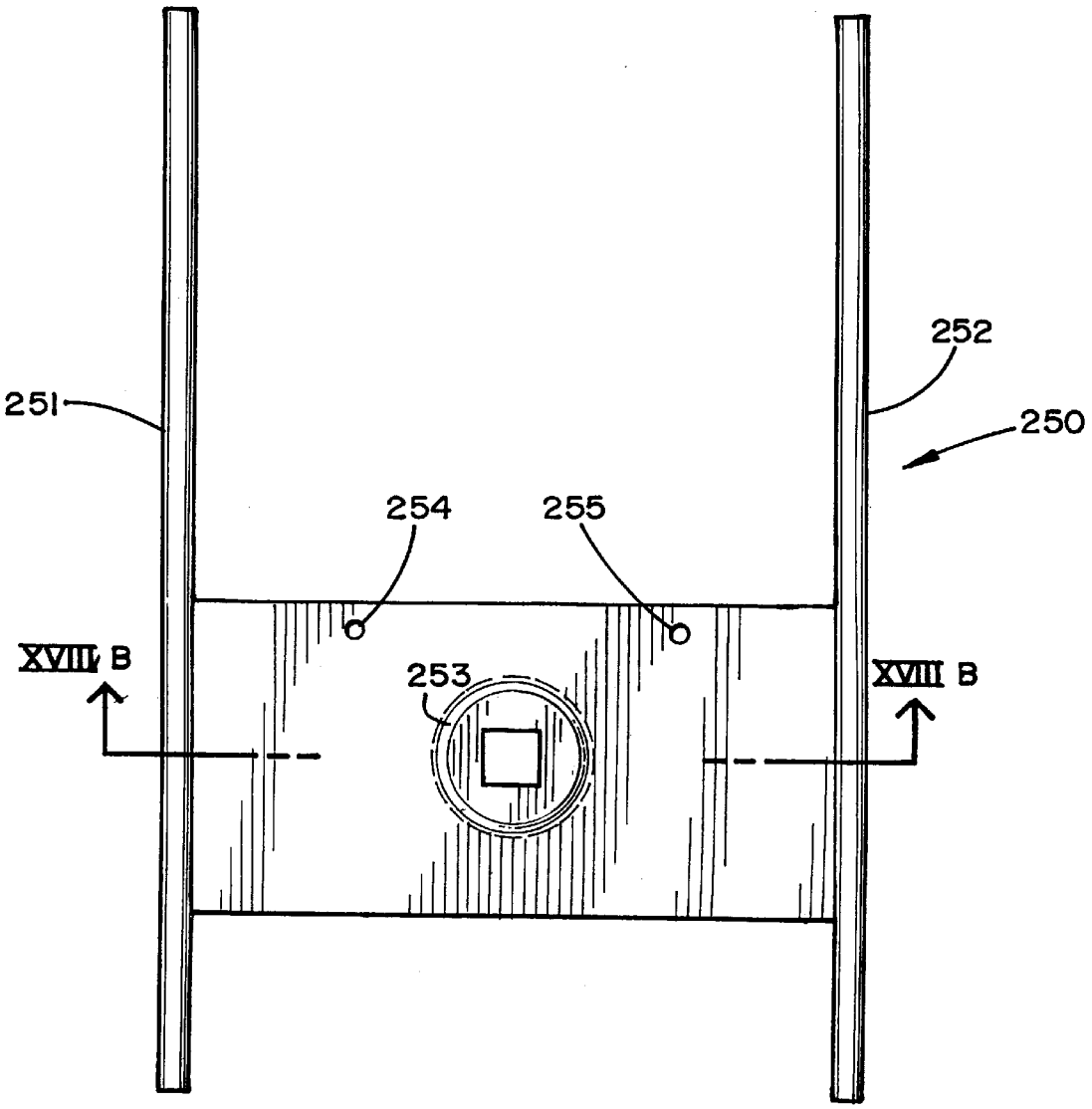
Fig. 18A

CHAIR WITH ARTICULATING TABLET AND INTERFACING TABLE

CROSS REFERENCE TO RELATED APPLICATIONS

The present application is related to the following coassigned, copending applications, each having a common inventor:

| Serial No. | Filing Date | Title |
|---|---|---|
| 08/747,798 | NOVEMBER 14, 1996 | VERTICALLY ADJUSTABLE TABLE |
| 08/064,102 | NOVEMBER 14, 1996 | TABLE |
| 29/051,003 | MARCH 1, 1996 | CHAIR DESIGN |

BACKGROUND OF THE INVENTION

The present invention concerns furniture having an articulating, storable tablet and a table adapted to interface with the tablet. The furniture is particularly adapted for supporting a computer in an optimal use position, although the present invention is not limited to only this use.

Increasing numbers of businessmen and travelers use portable computers while traveling in an effort to make productive use of time while waiting for flights or meetings. However, existing "public use" furniture at airports, reception areas, lobbies, and the like are not adapted to support such activities. Specifically, most existing "public use" furniture is not adapted to support a computer at a convenient work height and position. Part of the problem is that furniture for such public places must be both stylistic and very durable. Also, computer users characteristically work from a wide range of postural positions, such that it is difficult to design furniture flexible enough to meet each individual person's needs while also meeting the functional and stylistic requirements of a "public use" environment.

Some existing chairs have trays that are supported for articulated movement between a storage position and a front position. However, the tray support mechanisms tend to be expensive, complex, and unattractive. Further, known trays and tray support mechanisms tend to be unsatisfactory and non-durable, such that if used in a "public use" environment where they are abused and used with a high frequency, the trays become damaged and the mechanisms become non-operative or unreliable. It is particularly important that a storable tablet adapted for use in a furniture system adapted for use with computers be securely held when in its use position so that a computer rested thereon is not dropped.

Aside from the chair, tables are also needed that aesthetically and functionally complement chairs and that mate with chair trays. This allows the user to selectively expand their work surface area. It is noted that different tasks require different amounts of work surface areas, which is a considerable problem since space in public areas is often at a premium.

Accordingly, an apparatus is desired for solving the aforementioned problems and for providing a desired amount of style, functionality, and flexibility.

SUMMARY OF THE INVENTION

In one aspect, the present invention includes a chair, a tablet, and a support arm for operably supporting the tablet on the chair for articulated movement between a plurality of use positions generally in front of the chair, a side position beside the chair, and a vertical storage position located generally below the side position. A latch is provided that is operable only when the tablet is in the side position for releasing the tablet from the side position to the vertical storage position.

In another aspect, an article of furniture is provided including a chair, a support arm having a first end pivoted to the chair at a first pivot and a second end, and a tablet. The tablet includes a support panel pivoted to the second end at a second pivot. The tablet also includes a replaceable top panel secured to the support panel for providing a replaceable writing surface on the support panel.

In another aspect, a lounge-type chair is provided including a seat assembly having a ring-shaped bottom frame and a skirt draping downwardly from the ring-shaped frame. A base is provided that includes radially extending legs and floor-engaging casters supported on ends of the legs. A pivot rotatably supports the seat assembly on the base with the legs and castors being covered with the skirt.

In another aspect, a furniture system includes a chair having a tablet moveable between a plurality of horizontal use positions in front of the chair, and a table having a vertically adjustable work surface. The chair tablet has an edge adapted to mateably interface with a perimeter section of the table.

In another aspect, a table includes a base adapted to stably engage a floor, and further includes a table-top assembly having a support operably supported on the base for telescoping vertical movement, and further having a table top mounted on the support. A lift assist is operably connected to the base and the support for lifting the support. A button is positioned within a perimeter of the table top and operably connected to the lift assist for operating the lift assist.

These and other features and advantages of the present invention will be further understood and appreciated by those skilled in the art by reference to the following specification, claims, and appended drawings.

DESCRIPTION OF DRAWINGS

FIG. 18A is plan view of the tablet reinforcement member for stiffening the tablet shown in FIG. 18;

FIG. 18B is a cross sectional view taken along the line XVIIIB—XVIIIB in FIG. 18A;

DETAILED DESCRIPTION OF PREFERRED EMBODIMENT

Figure 1:
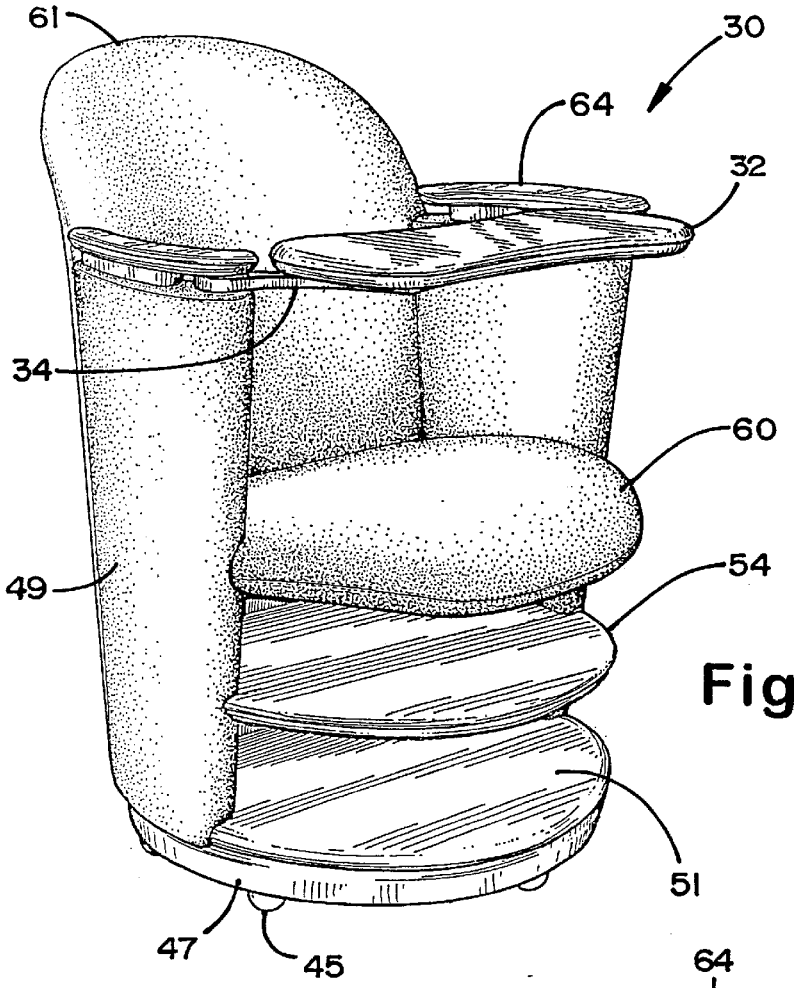
FIG. 1 is a perspective view of a chair embodying the present invention, the chair including a movable, storable tablet.
Figure 2:
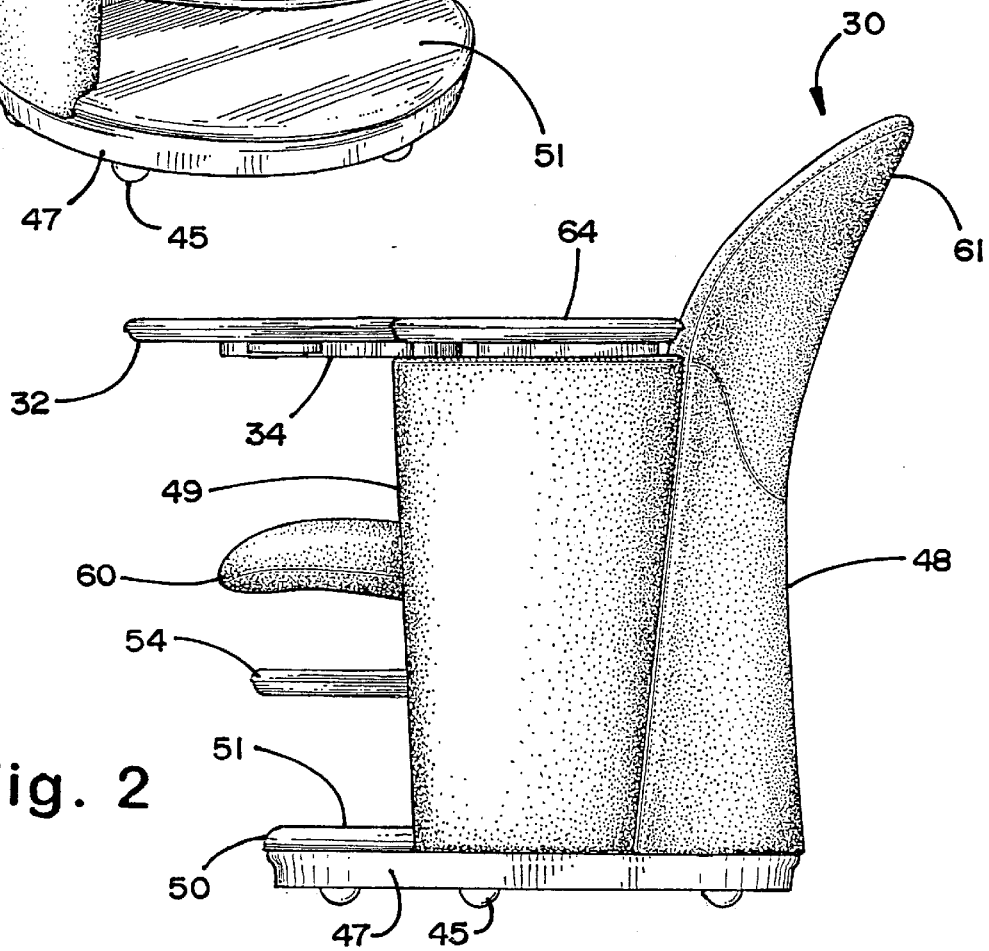
FIGS. 2–4 are side, front, and top views of the chair of FIG. 1, the tablet being shown in a front position for use.
Figure 3:
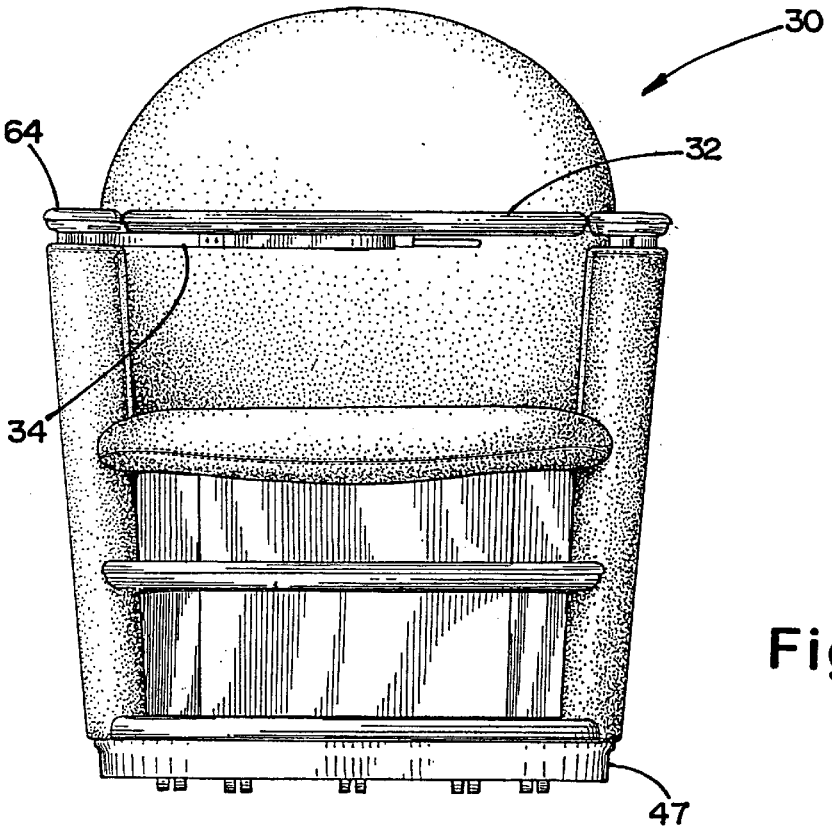
Figure 4:
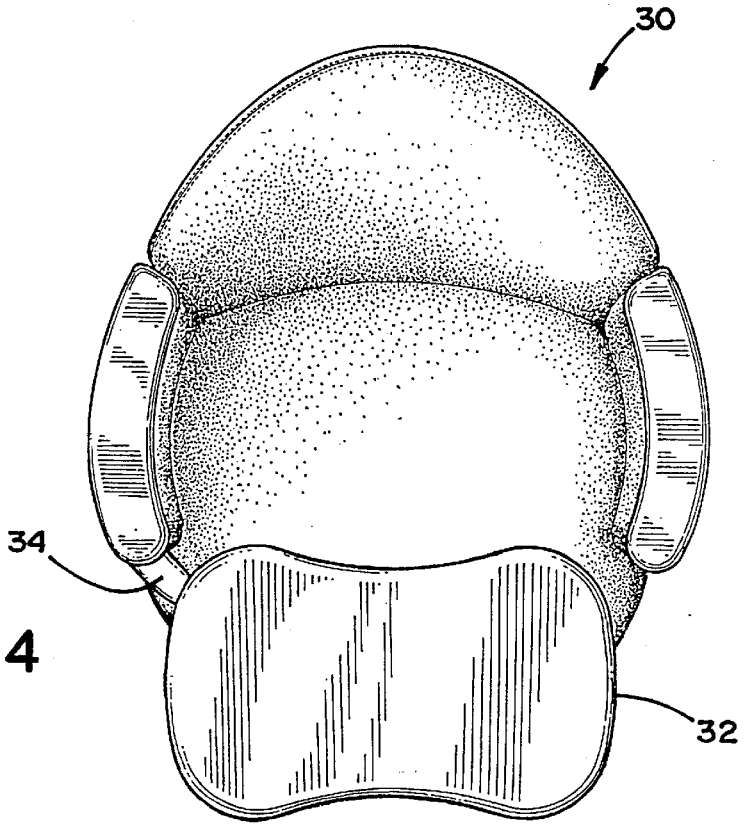
Figure 5:
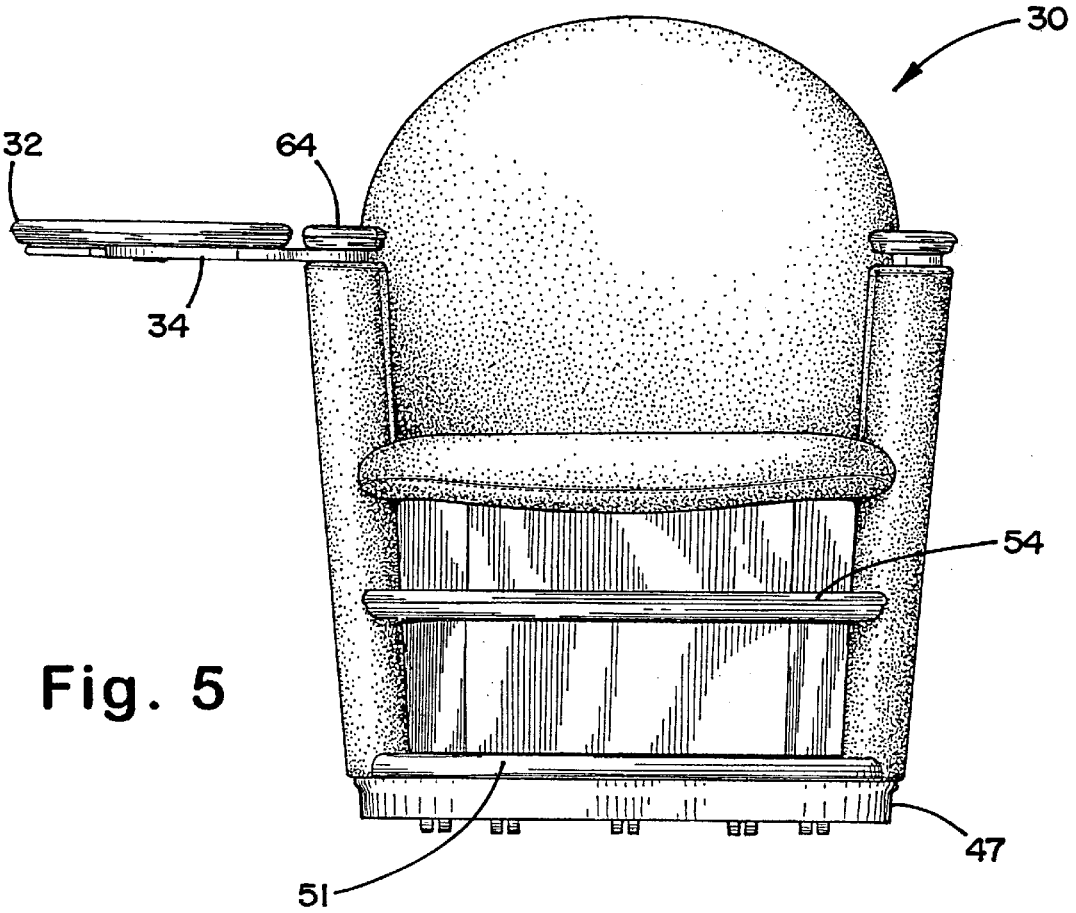
FIGS. 5–6 are front and top views of the chair of FIG. 1, the tablet being shown in a side position.
Figure 6:
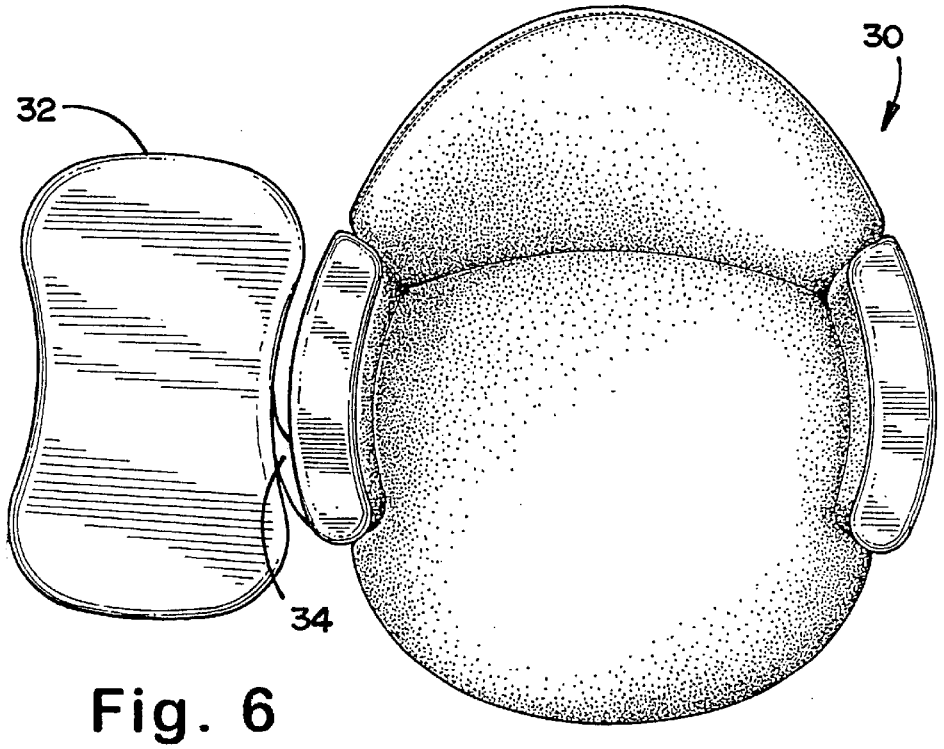
Figure 7:
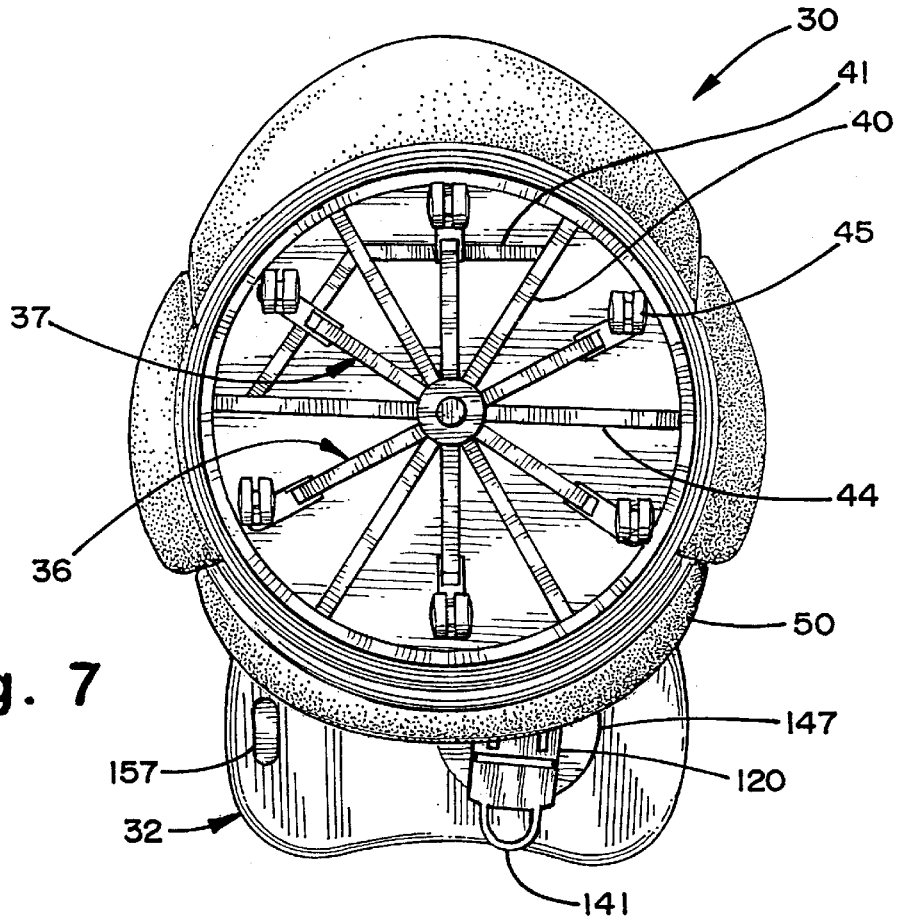
FIGS. 7–8 are bottom views of the chair shown in FIG. 1, the tablet being shown in a front position in Fig. 7 and in a side position in FIG. 8.
Figure 8:
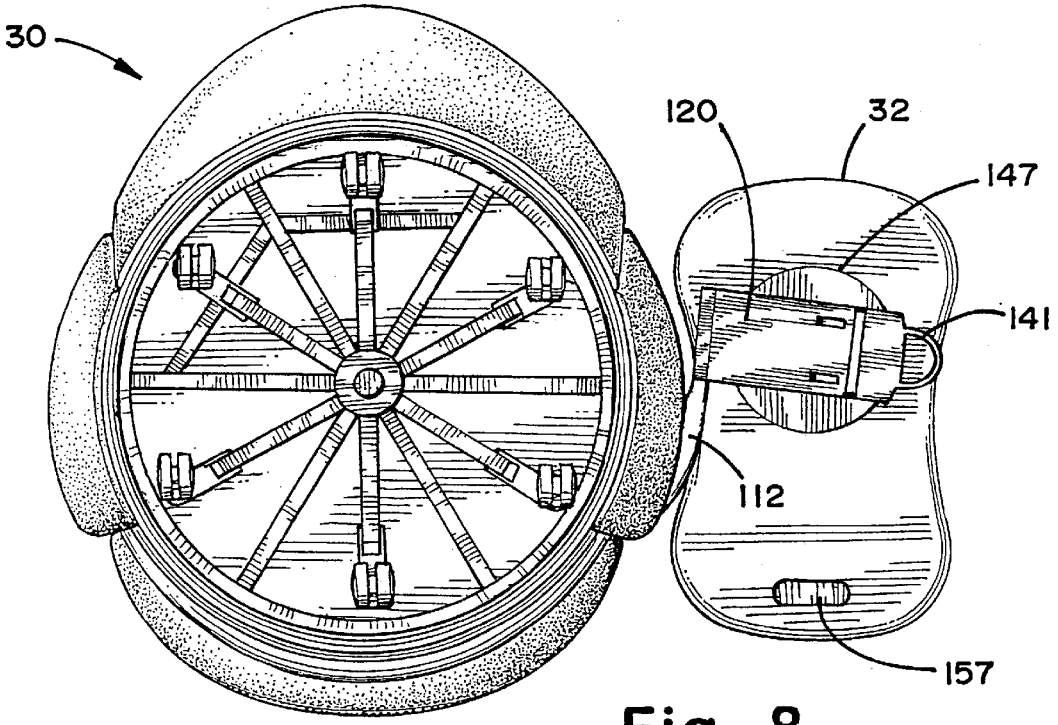
Figures 13, 16:
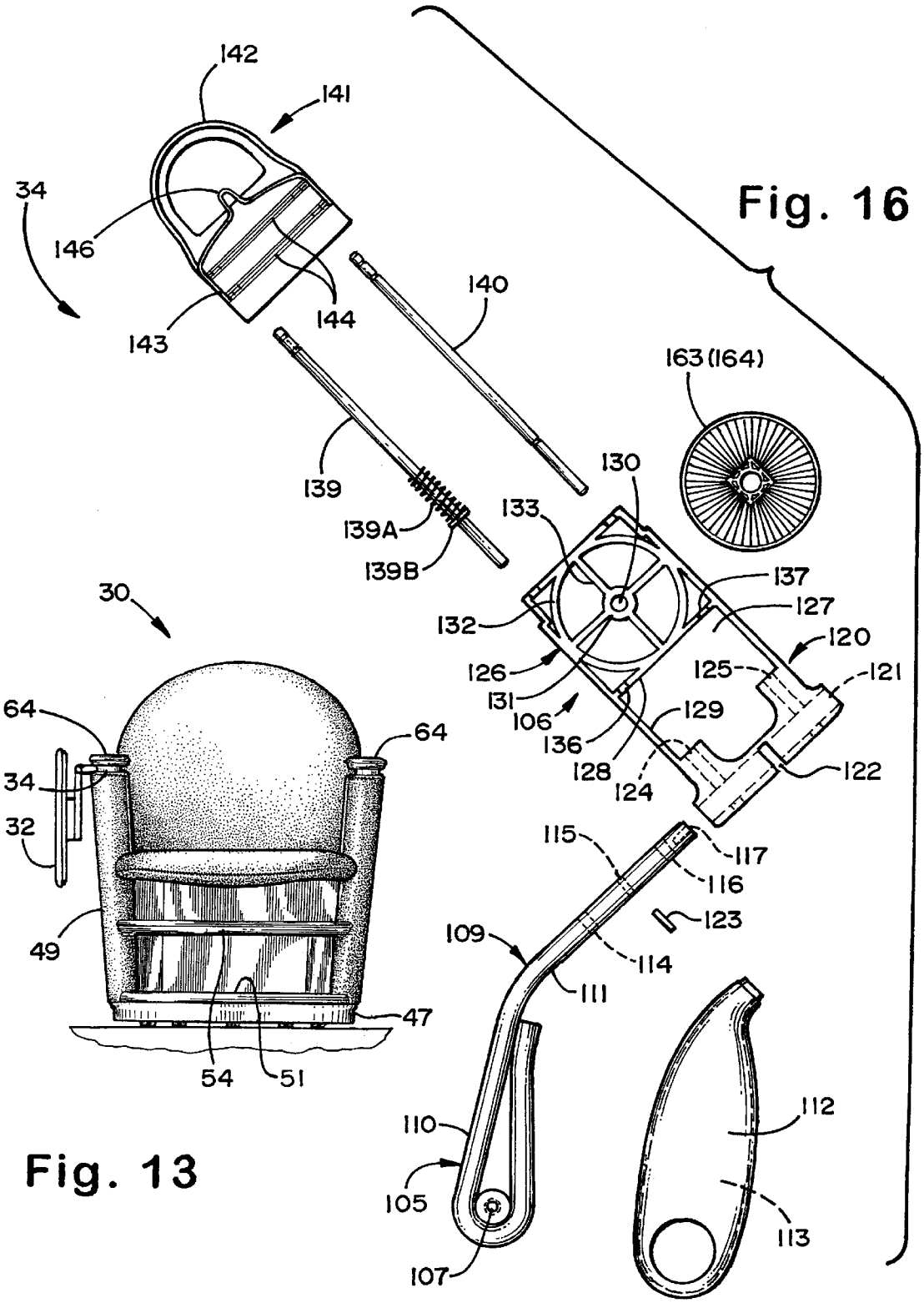
FIG. 13 is a front view of the chair shown in FIG. 1, the tablet being shown in a vertically folded position adjacent the chair seat.
FIG. 16. is an exploded plan view of the latching mechanism for the tablet shown in FIG. 14.
Figure 15:
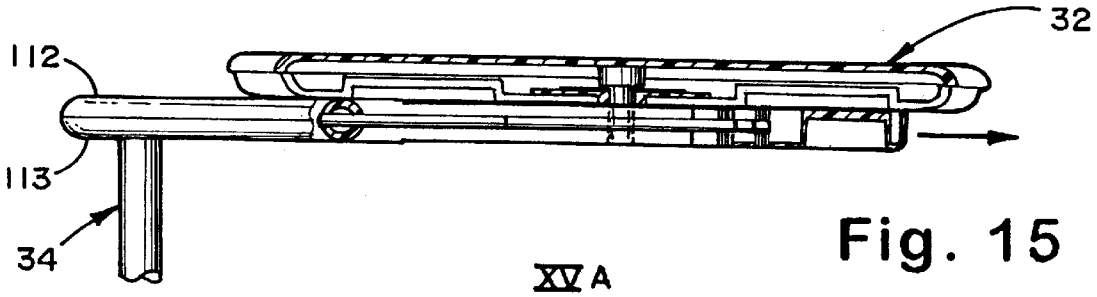
FIGS. 15–15A are cross sectional views taken along the planes XV—XV and XVA—XVA in FIG. 14.

A furniture system embodying the present invention includes a mobile rotatable chair 30 (FIGS. 1–8) and a table 31 (FIGS. 19–22) adapted to interface with the chair 30 to provide a flexible work area. The chair 30 includes a tablet 32 moveable between a plurality of front positions (FIGS. 1–4), a side position (FIGS. 5–6) and a vertically pivoted storage position (FIG. 13). The table 31 includes a height-adjustable table top 33 having a perimeter adapted to mateably abut and interface with the tablet 32. The tablet 32 is supported by a support arm 34 that is pivoted to the tablet 32 at one end and to the chair 30 at its other end, such that the tablet 32 articulatingly swings about two spaced apart axes between and around the side and front of the chair 30 substantially to any desired position and orientation. The table top 33 is vertically adjustable, so that it can be raised to a position horizontally aligned with tablet 32. Alternatively, the table top 33 can be lowered below the tablet 33. The result is a flexible work surface for selectively supporting a computer and/or work product that can be arranged in a variety of configurations to satisfy specialized needs.

The chair 30 (FIG. 9) includes a seat assembly 35, and a base 36 for movably supporting seat assembly 35. Seat assembly 35 includes a bottom frame 37 having a center piece 38, an outer ring 39, and radially extending spoke-like reinforcements 40 for supporting outer ring 39 on center piece 38. Braces 41 are added as desired between reinforcements 40. Base 36 includes a hub 43 with radially extending legs 44. Castors 45 are operably attached to the outer ends of the legs 44. A protrusion 46 extends upwardly from hub 43 for rotatably engaging a hole in center piece 38. A skirt 47 attaches around outer ring 39 and drapes downwardly to cover the base 36. The seat assembly 35 is rotatable on base 36 as well as base 36 is rotatable and translatable on a floor, thus allowing the chair to be easily moved. Castors 45 can be designed to include a sufficient amount of friction to prevent undesired movement, but it is contemplated that the chair 30 will usually be used on a carpeted surface, such that undesired chair movement or creep will not be a problem.

Seat assembly 35 includes a semi-cylindrical back shell 48, and a pair of opposing armrest-forming side shells 49, each attached to a top of outer ring 39. Shells 48 and 49 include foam attached to steel inner frames. A foot rest 50 is attached to a front of outer ring 39, and a bottom flat panel 51 is attached to a top of bottom frame 37 behind foot rest 50. Flat panel 51 includes a rear edge 52 that is spaced inside of the outer ring 39 so that the shelf formed by bottom flat panel 51 is not so deep that it is difficult to reach completely to a back of the shelf. A back wall 53 is formed along the rear edge 52 and extends between the side shells 49. Back wall 53 extends upwardly to the bottom of the seat pan 57. A secondary shelf 54 (FIG. 5) similar to shelf/panel 51 is attached between the seat pan 55 and panel 51.

Seat pan 55 (FIG. 9) is supported by a pair of seat pan supporting brackets 56 and 57 are attached to shells 48 and 49, one being positioned in front of back wall 53 and the other being positioned behind the back wall 53. Seat pan 55 includes a rigid ring 58 covered with a resilient webbing 59. The webbing 59 spans across an open interior of the ring 58. A seat cushion 60 is placed on the webbing 58, and then the assembly of the cushion 60 and ring 58 is covered with upholstery or fabric. A back extension shell 61 is attached to a top of the back shell 48. Optionally, the back extension shell 61 is spaced above the top of the back shell 48 by spacers 62 for aesthetics. Cushions, such as back extension shell 61A, are attached to shells 48, 49 and 61, and a covering of upholstery, fabric, leather, or other material is attached over the seat assembly 35 to form an attractive chair. Notably, a zipper 63 (FIG. 10) can be used along the center back seam to facilitate assembly. Armrests 64 are formed by attachment of opposing half members 64A and 64B (FIG. 9) to the top of side shells 49.

Figure 11:
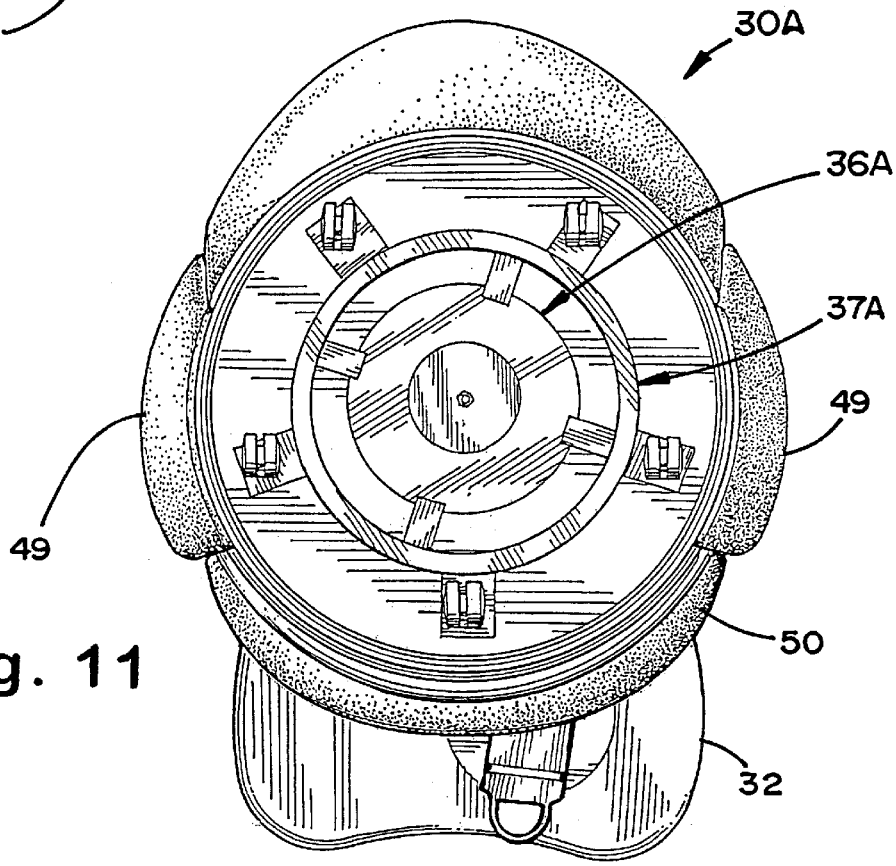
FIG. 11 is a bottom view of a modified chair embodying the present invention, the chair being similar to the chair of FIG. 1, but including a modified castored base.
Figure 12:
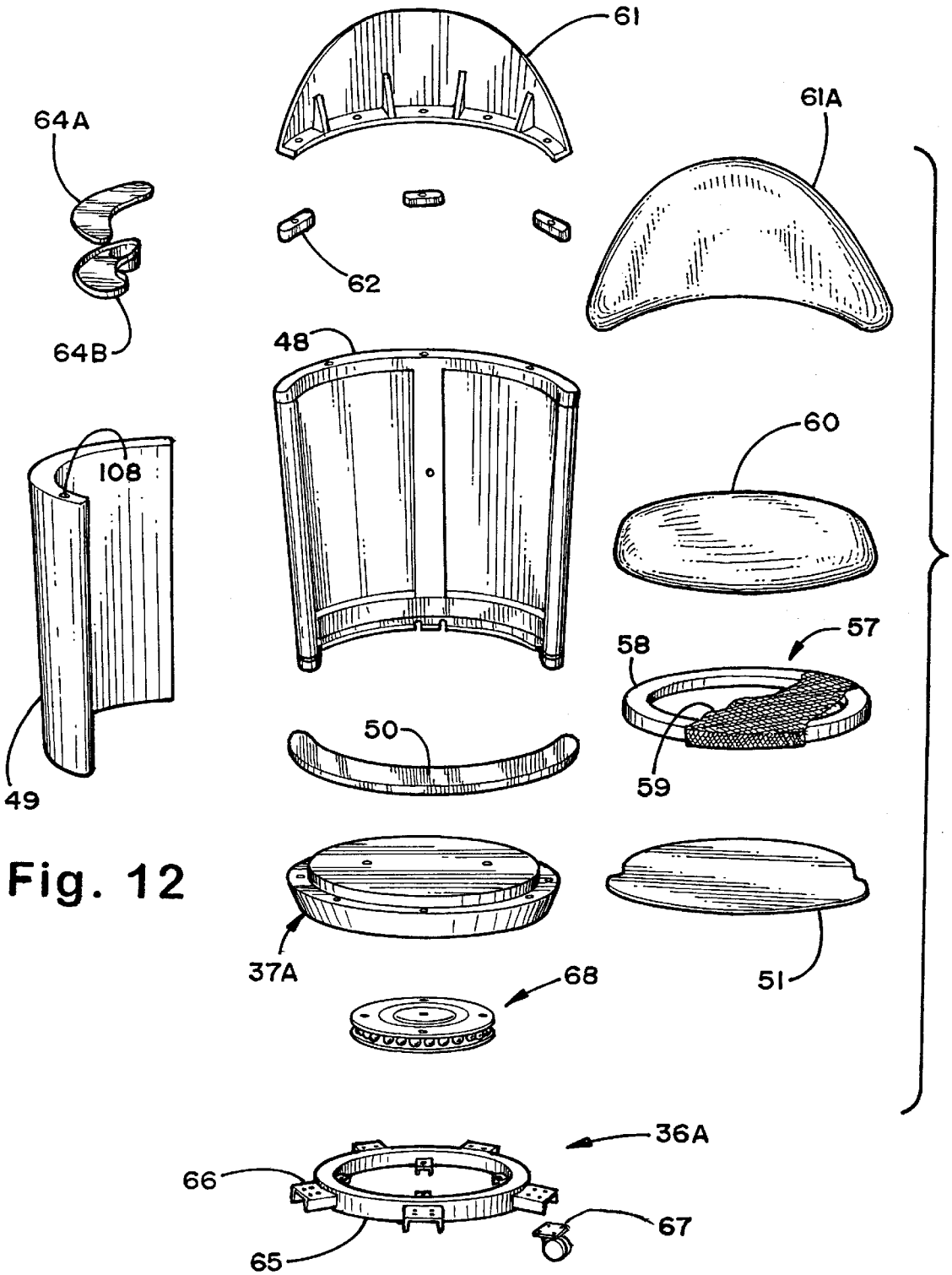
FIG. 12 is an exploded view of the chair shown in FIG. 11.

In a modified form, a chair 30A (FIGS. 11 and 12) includes components comparable to the chair 30, but chair 30A includes a modified base 36A and a modified bottom frame 37A. Bottom frame 37A (FIG. 12) comprises a solid disk, such as solid or cast material. The modified base 36A includes a ring frame 65 with castor-supporting platforms 66 radiating outwardly therefrom, castors 67 attached to the platforms 66, and a bearing plate assembly 68 for rotatably supporting base 36A on bottom frame 37A. The bearing plate assembly 68 includes a top plate attached to modified chair bottom frame 37A, a bottom plate attached to ring frame 65, and roller bearings between the two plates.

Figure 12A:
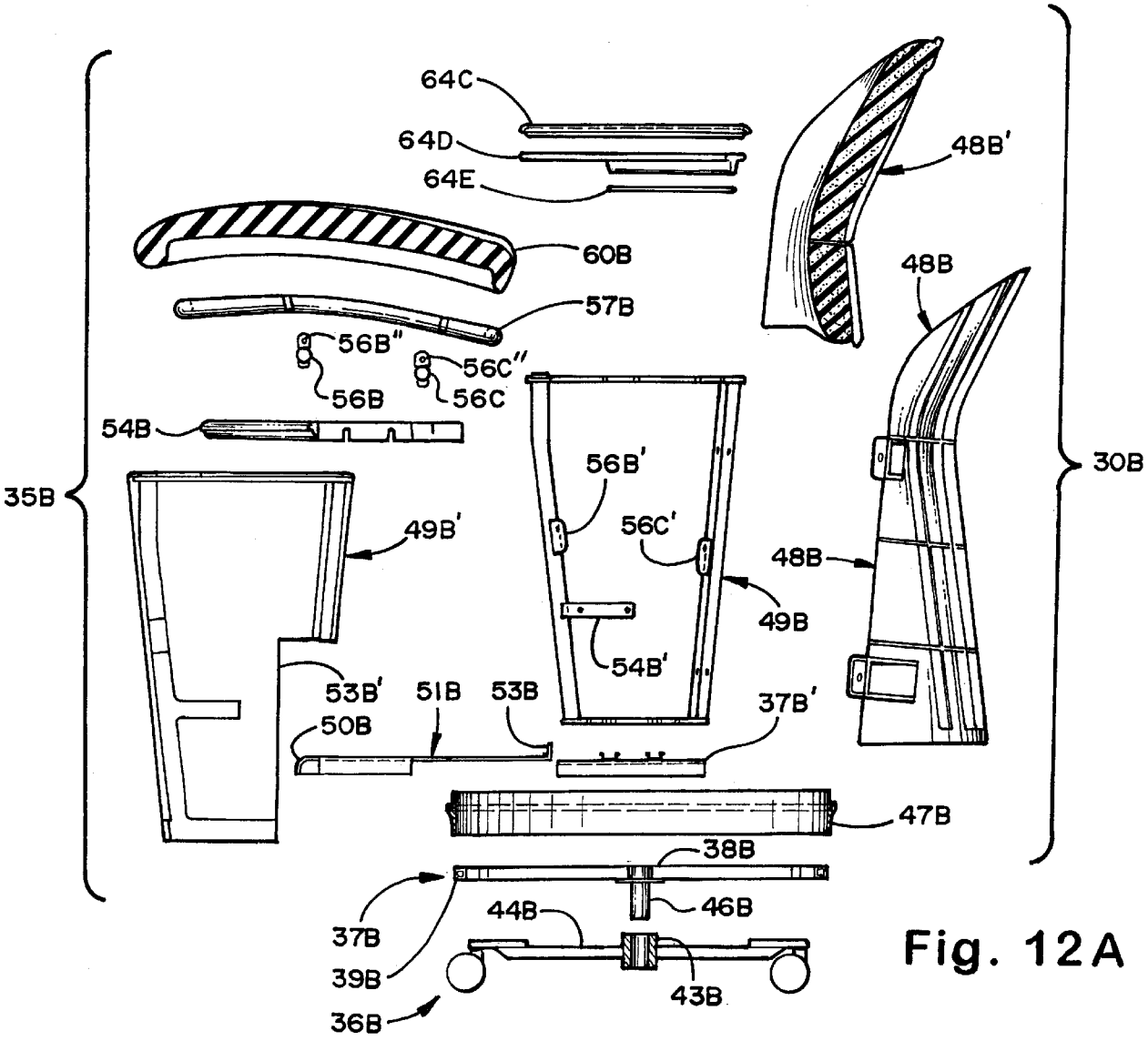
FIG. 12A is an exploded view of a second modified chair embodying the present invention.

A second modified chair 30B (FIG. 12A) includes components similar to chair 30. However, chair 30B includes a modified seat assembly 35B and a modified base 36B. Seat assembly 35B includes a circular bottom frame 37B having a center piece 38B, an outer ring 39B, and radially extending spoke-like reinforcements for supporting the ring 39B on the center piece 38B. Braces are included to rigidify the reinforcements. Base 36B includes a hub 43B with radially extending legs 44B adapted to support castors on their ends. A protrusion 46B extends downwardly from center piece 38B for engaging a hole in hub 43B. A skirt 47B attaches around outer ring 39B and drapes downwardly around the base 36B.

Seat assembly 35B is generally barrel-shaped, and includes a semi-cylindrical back shell 48B molded from structural plastic and a foam piece 48B' that attaches to an inside of shell 48B. A pair of opposing armrest-forming sides are formed from steel subframes 49B and a pair of inner cushions 49B' attached inside of subframes 49B. A platform support or cross brace 37B' attaches to bottom frame 37B. Platform support 37B' optionally includes fasteners such as hooks for snap attachment of bottom shelf 51B. Bottom shelf 51B includes a cascading front lip 50B adapted to function as a footrest and a back lip 53B forming a back wall to the shelf. A mid-height shelf 54B is adapted to attach to the inside of back and side components 48B and 49B, such as at bracket 54B' on side subframe 49B. Transverse brackets 56B and 56C attach between side shells 49B at brackets 56B' and 56C' for supporting a seat frame 57B and a seat cushion 60B. Seat frame 57B is attached to brackets 56B' and 56C' at flanges 56B" and 56C". Armrests are formed by opposing half members 64C and 64D attached to a reinforcement plate 65E, plate 65E being previously attached to a top of side shell 49B. It is contemplated that different height and width shells 48B and cushions 48B' can be constructed for supporting persons having different body sizes.

Figure 9:
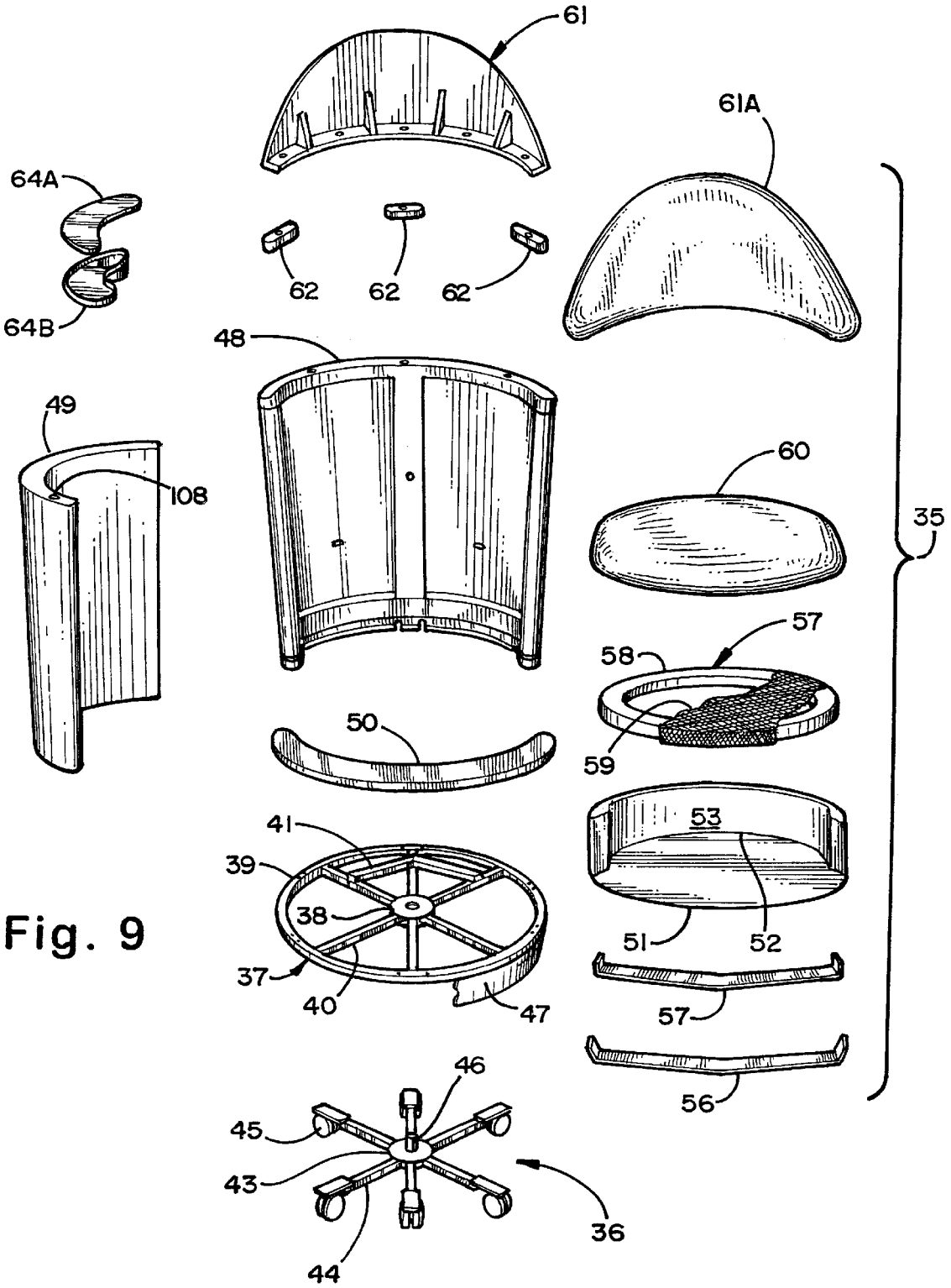
FIG. 9 is an exploded view of the chair of FIG. 1, not including the tablet.
Figure 10:
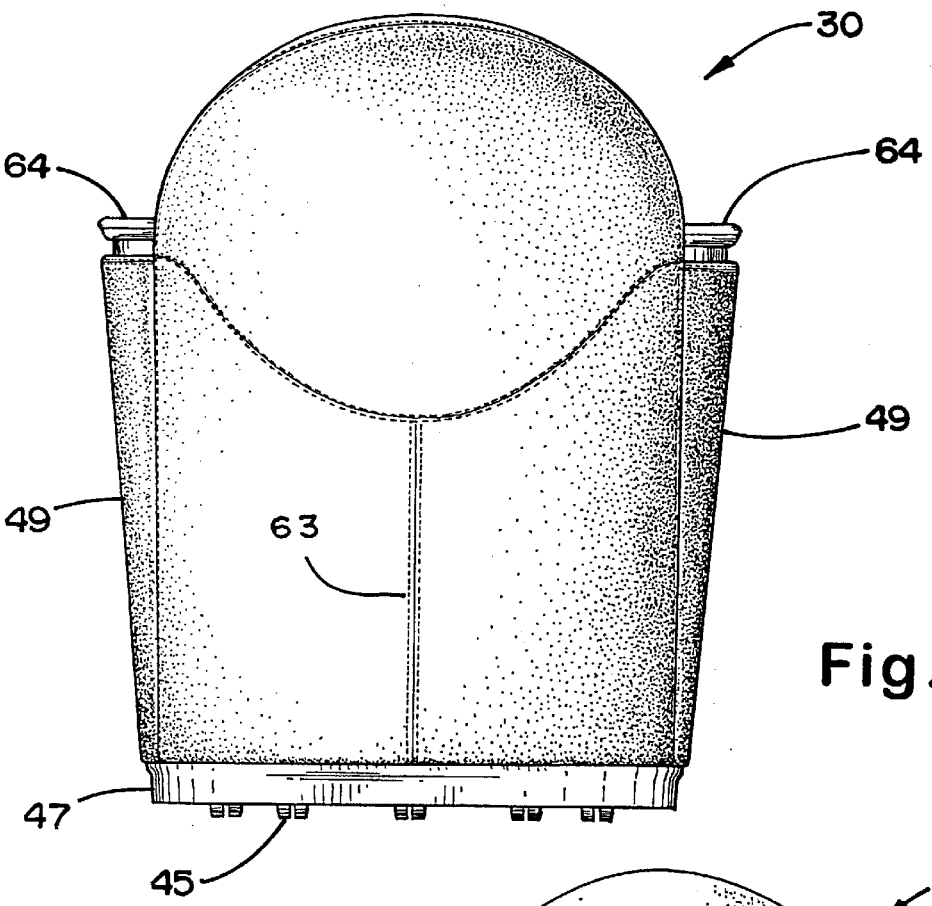
FIG. 10 is a rear view of the chair shown in FIG. 1.
Figure 14:
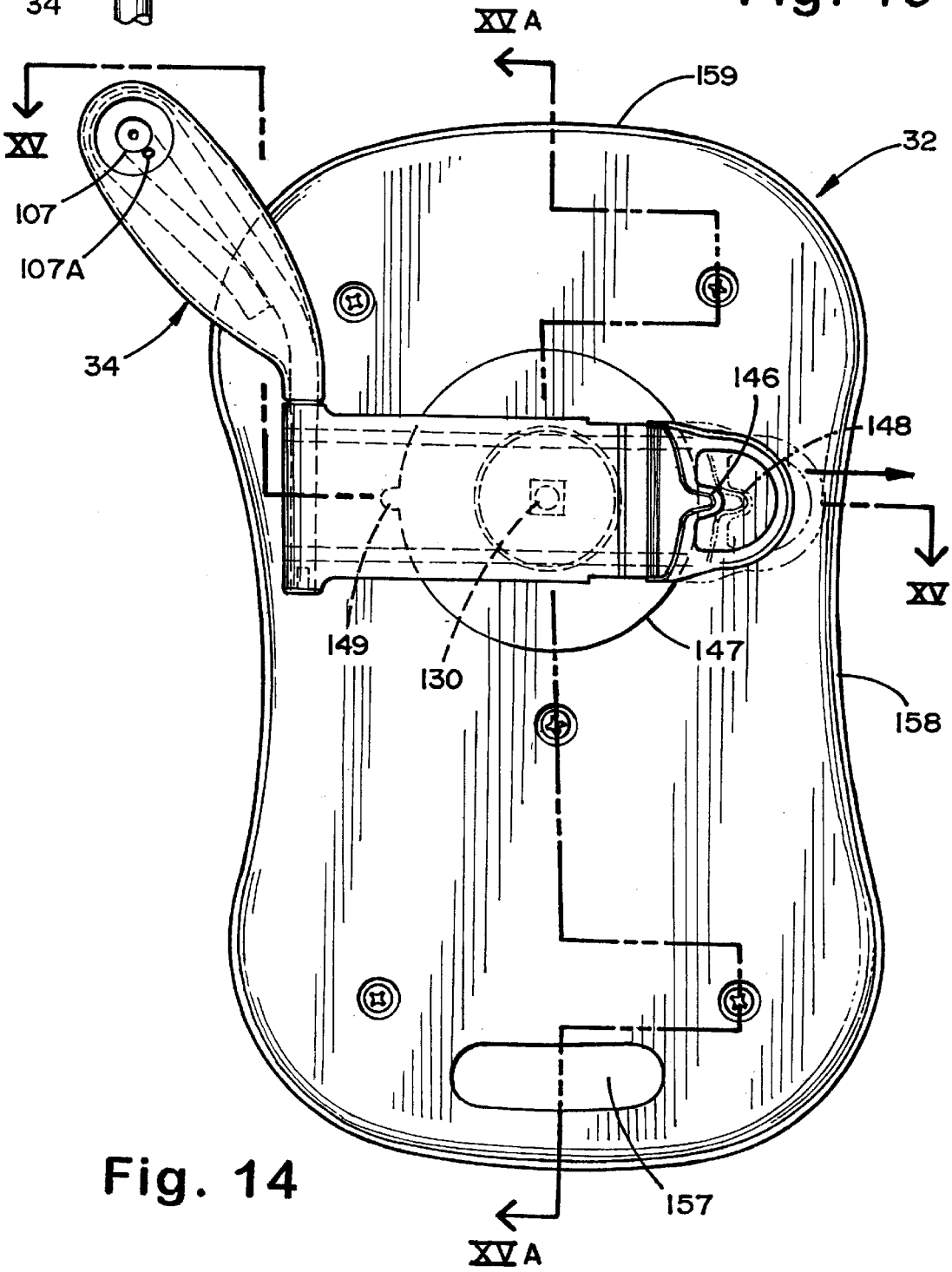
FIG. 14 is a bottom view of the tablet shown in FIG. 1.
Figure 15A:
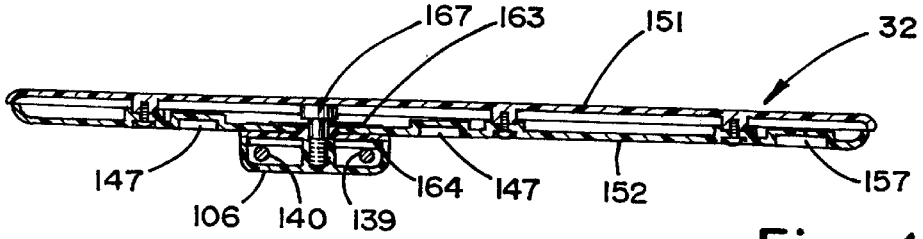
Figure 17:
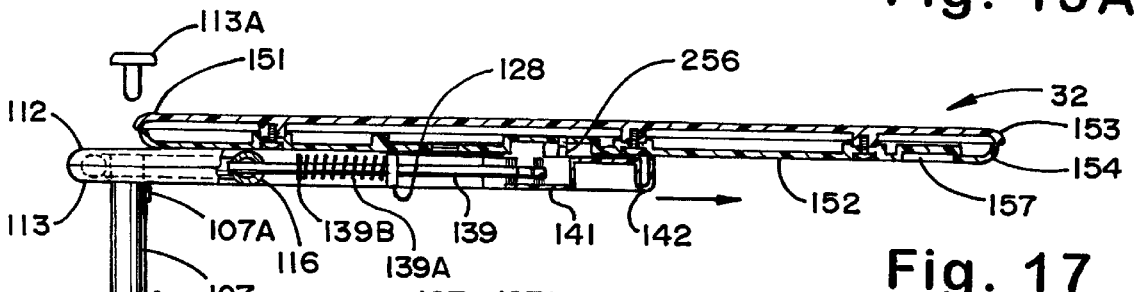
FIG. 17 is a cross sectional view of the tablet similar to FIG. 15A, but with the tablet being rotated 90 degrees relative to the support arm before taking the cross section.

Support arm 34 (FIG. 14) is particularly adapted to securely support tablet 32, yet to permit the articulated movement of tablet 32 between various horizontal use positions (FIGS. 4 and 6), and to the vertical storage position (FIG. 13) wherein the tablet 32 is stored vertically adjacent a side of chair 30. Support arm 34 (FIG. 16) includes a weldment 105 and a pivot member 106. Weldment 105 includes a vertical rod section 107 for pivotally engaging a hole 108 in a top of side frame 49 (FIG. 9). A stop 107A (FIG. 14) is welded to a side of vertical rod section 107. The stop 107A is constructed to engage ends of a groove in armrest plate 64E (FIG. 12A) to limit the rotation of tablet 32. For example, it is contemplated that the stop 107A will limit the rotation of tablet 32 so that tablet 32 is horizontally moveable between a side position where it does not undesirably hit the side of chair 30 and moveable to a front position where it does not undesirably swing into and hit a person sitting in chair 30. Weldment 105 (FIG. 16) further includes a bent rod 109 with a looped end 110 looped around and welded to rod 107, and with a straight end 111 extending from the looped end 110. Top and bottom trim covers 112 and 113 cover opposing sides of the looped end 110 in a sandwich-like arrangement. The covers 112 and 113 include apertures and mating bosses for receiving screws to secure the covers together. Also, an end cap 113A (FIG. 17) engages a top end of vertical rod section 107 for securely rotatingly holding the cover 112. The straight end 111 of bent rod 109 includes three transverse holes 114, 115 and 116 spaced from its tip, and a longitudinally extending hole 117 in its tip.

Pivot member 106 includes a rod-receiving end section 120 with a bore 121 therein for rotatingly receiving the straight end 111. A slot 122 is formed in the end section 120. A retainer/clip 123 is extended through slot 122 into center hole 115 to secure pivot member 106 to rod end section 111. A trim button is extended through end hole 121 into engagement with axial hole 117 in the end of rod end section 111. The trim button includes an enlarged head providing an attractive appearance. Notably the button can also be threaded and/or structured for holding the pivot member 106 on rod end section 111.

A pair of holes 124 and 125 are formed in rod-receiving end section 120, the holes being alignable with holes 114 and 116 in bent rod 109. Pivot member 106 includes tablet-engaging end section 126 attached to rod-receiving end section 120 by a body panel 127. Reinforcement ribs 128 and 129 extend along the edges of body panel 127 for rigidifying the pivot member 106. A pivot hole 130 is formed in tablet-engaging end section 126, and a boss-like sleeve 131 is formed around the pivot hole 130 to stabilize the pivot pin extended through the hole 130. A circular rib 132 is formed around sleeve 131, and connected to the sleeve 131 by radiating ribs 133. Secondary stabilizing ribs 134 and 135 are formed on body panel 127 transverse to edge-located ribs 128 and 129. Aligned holes 136 and 137 are formed in the ribs under body panel 127, the holes 136 and 137 aligning with holes 114 and 116 in the rod-receiving end section 120.

A pair of identical latch rods 139 and 140 are attached to a handle 141, and extend from handle 141 through holes 136 and 137, respectively, and also through holes 114 and 116, respectively, into the holes 114 and 116 in bent rod 109.

A spring 139A (FIG. 17) is positioned on rod 139 (and another spring on rod 140). As assembled, spring 139A is compressed between a washer 139B attached to rod 139 and the reinforcement rib 128 such that it biases latch rod 139 (and rod 140) to a normally extended/latched position. Handle 141 includes a grip loop 142 and further includes a configured section 143 with ribs 144 adapted to frictionally engage the ends of latch rods 139 and 140. Alternatively, a key can be used to retain the latch rods 139 and 140 to handle 141. Configured section 143 also is shaped to slidably engage the tablet-engaging end section 126 of pivot member 106 inside of outer ribs 129. This allows the handle 141 to be slid between a latched position wherein the latch rods 139 and 140 engage holes 114 and 116 in bent rod 109, and an unlatched position wherein the latch rods 139 and 140 disengage holes 114 and 116. When disengaged, the pivot member 106 (and tablet 53) can be pivoted between a tablet-horizontal side use position (see FIG. 6) and a tablet-vertical storage position (see FIG. 13). A protrusion 146 extends from handle 141 upwardly for engaging a track 147 on the underside of tablet 32. The track 147 (FIG. 14) comprises a depression that extends circumferentially around the pivot hole 130. The track 147 receives and engages the protrusion 146 to prevent the handle 141 from being moved when the tablet 32 is rotated out of the storage position on the tablet 34. The track 147 includes a recess 148 for receiving the protrusion 146 when the tablet 32 is in the storage position, thus allowing the handle 141 to be moved to release the latching rods 139 and 140 only at a predetermined time for moving the tablet 34 to the storage position. In other words, in most positions of the tablet 32 in front of chair 30, the latch cannot be released. The latch is designed to be inoperable when the tablet 32 is positioned in the most regularly used positions in front of chair 30. Notably, the track 147 includes a second recess 149 positioned on an opposite side of the tablet 32 so that the same tablet 32 can be used on either the right armrest or left armrest of the chair 30. Latching rods 139 and 140 can be held in the latched position by various means, such as by the bias spring 139A operably engaged between the handle 141 and the pivot member 106, or by detents on the handle 141 and on the pivot member 106.

Figure 18:
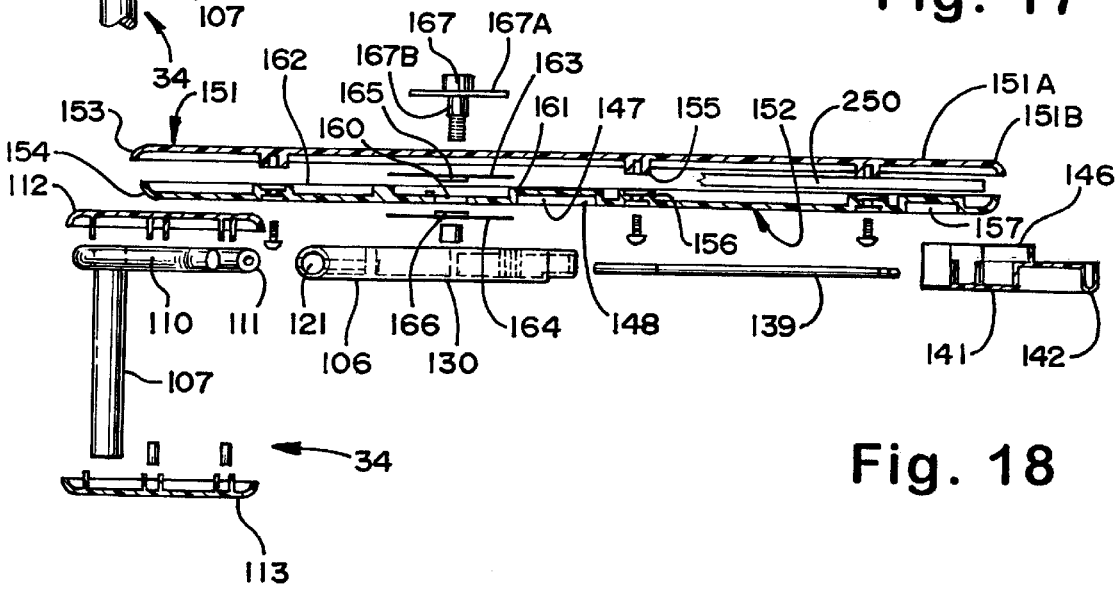
FIG. 18 is an exploded view of the tablet shown in FIG. 17, including a reinforcement member.

Tablet 32 (FIGS. 17–18) includes upper and lower plates 151 and 152 having edge flanges 153 and 154 adapted to matingly engage, with the upper edge flange 153 being slightly outboard of the lower edge flange 154 for aesthetics. The upper plate 151 includes attachment bosses 155, and the lower plate 152 includes bosses 156 for receiving the tips of bosses 155. Screws are extended through lower bosses 156 into upper bosses 155 to secure plates 151 and 152 together. Lower plate 152 includes a finger recess 157 at one end to facilitate grasping the tablet 32 to manipulate the tablet 32. The outer perimeter of tablet 32 defines a generally rectangularly shaped perimeter, but with generously radiused corners connecting concave long sides 158 (FIG. 14) and outwardly curved convex short sides 159. The concave long sides 158 are gently curved, and are shaped to closely match the shape of at least a portion of table top 33, as discussed below.

The lower plate 152 is particularly adapted to be rotatably mounted to the tablet-engaging end section 126. For this purpose, the lower plate 152 (FIG. 18) includes a pivot hole 160 and a reinforcement rib 161 extending around pivot hole 160. A pattern of angled and orthogonal ribs 162 extend from the edges of lower plate 152 to the track 147 and further rigidify the plate 152. Upper and lower stiffening discs 163 and 164 are positioned on opposite sides of lower plate 152, and each include a pivot hole 165 and 166, respectively, that align with pivot hole 160. A pivot pin 167 includes a fender washer 167A and a shaft 167B that extends through pivot holes 165, 160, and 166, and is rotatably secured in pivot hole 130 in pivot member 106. Notably, pivot pin 167 does not extend through top plate 151, but instead is installed before upper plate 151 is attached to lower plate 152.

To assemble tablet 34 to chair 30, stiffening discs 163 and 164 are sandwiched about lower plate 152, and then attached to pivot member 106. (Compare, FIGS. 17 and 18.) Thereafter, the upper plate 151 is attached to lower plate 152 by attachment screws that extend upwardly through lower plate 152 into upper plate 151. Straight rod 111 of weldment 105 is extended into the mating hole 121 of pivot member 106, and secured therein by a headed screw 123. The vertical rod section 107 of weldment 105 is extended into a pivot-forming hole 108 (FIG. 9) in a top/front of side shell 49 in an area under the front of the chair armrest (either the right or the left).

The upper plate 151 (FIG. 18) includes an inlaid upper layer of MELAMINE laminate or other tough material optimally suited to resist scratching and marring. The material is inlaid so that its edges are protected and so that it is not easily or accidentally removable. The inlaid material can be pulled off of the tablet 32 and replaced without tearing apart the tablet 32. Alternatively, where the inlaid material is adhered so securely that it is not removable without damaging the upper plate 151, the tablet 32 can be disassembled and the entire upper plate 151 replaced. It is noted that the inlaid material also can be a wood inlay, or wood simulating inlay, or can be an aesthetically colored plastic, such that a distinctive tablet and chair results.

In a preferred embodiment, a tablet arm support insert 250 (FIG. 18A–18B) is inserted between upper and lower plates 151 and 152 (FIG. 18) to stiffen the tablet assembly. Insert 250 (FIGS. 18A–18B) includes side rods 251 connected by a cross plate 252 at one end. Side rods 251 can be located inboard or outboard of the attachment bosses 155 and 156. Cross plate 252 includes a circular depression 253 that mateably fits into the pocket formed by rib 61 (FIG. 18) formed around pivot hole 160. A pair of holes 254 and 255 are formed in cross plate 252. The hole 254 is adapted to receive a stop screw 256 (FIG. 17) that engages sides 128 or 129 to limit the rotation of tablet 32 about pivot 130. The rotation of tablet 32 is limited so that the tablet 32 naturally rests in a square front position (see FIG. 28) in front of chair 30. The hole 254 is for use when the tablet 32 is attached to a right armrest, and the hole 255 is for use when the tablet 32 is attached to a left armrest of chair 30.

Figure 18D:
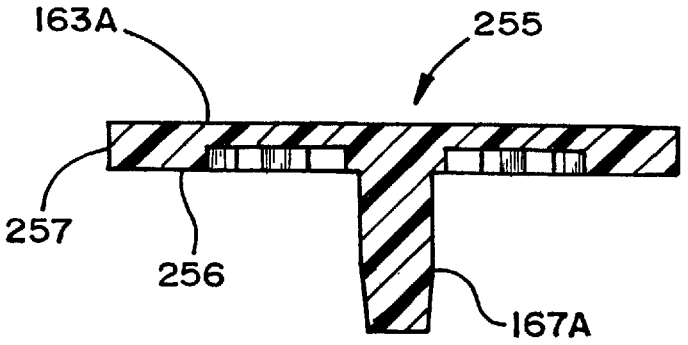
FIG. 18D is a cross sectional view taken along the line XVIIID—XVIIID in FIG. 18C.
Figure 18C:
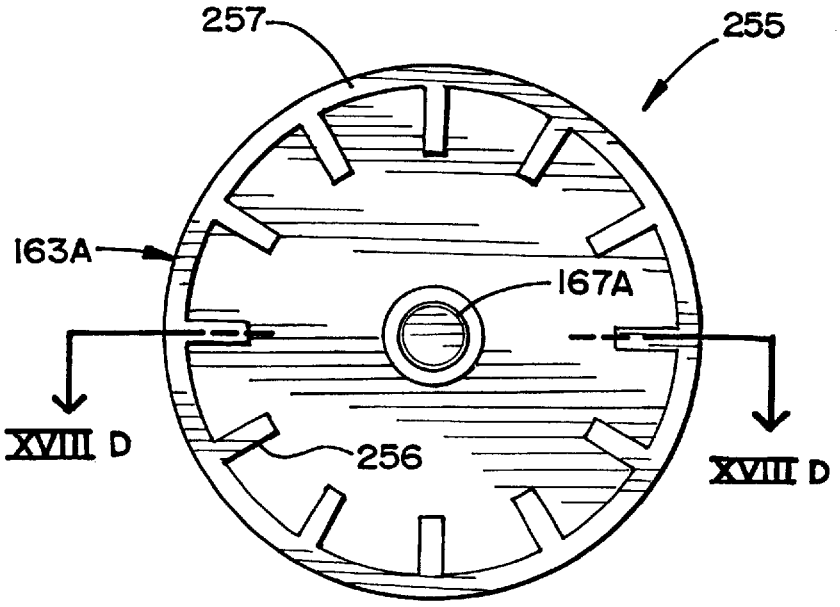
FIG. 18C is a plan view of a pivot member including an integral stiffening disc and pivot pin.
Figure 19:
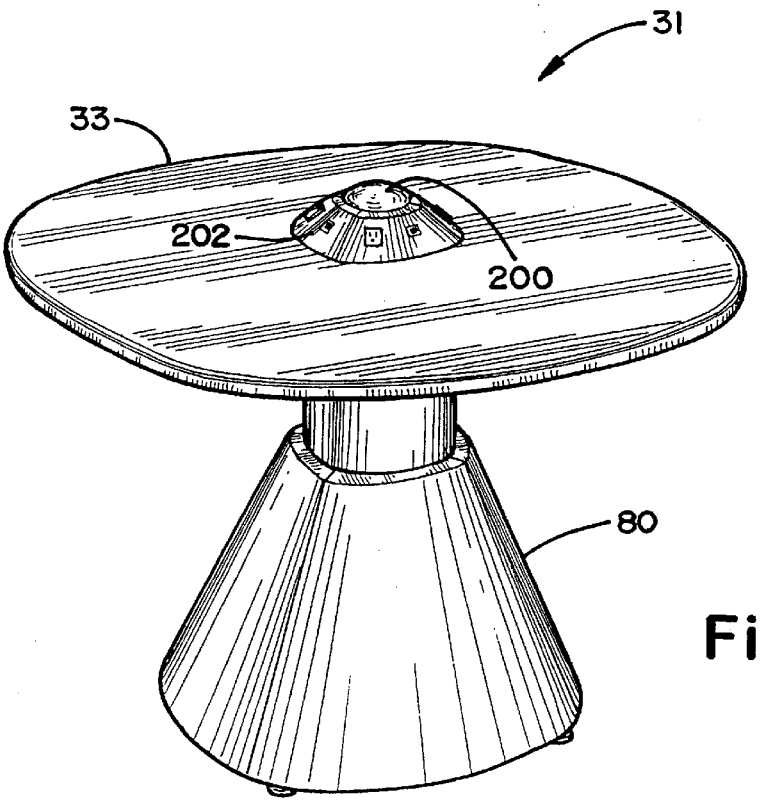
FIG. 19 is a perspective view of a table embodying the present invention, the table being adapted to interface with the tablet of the chair.
Figure 20:
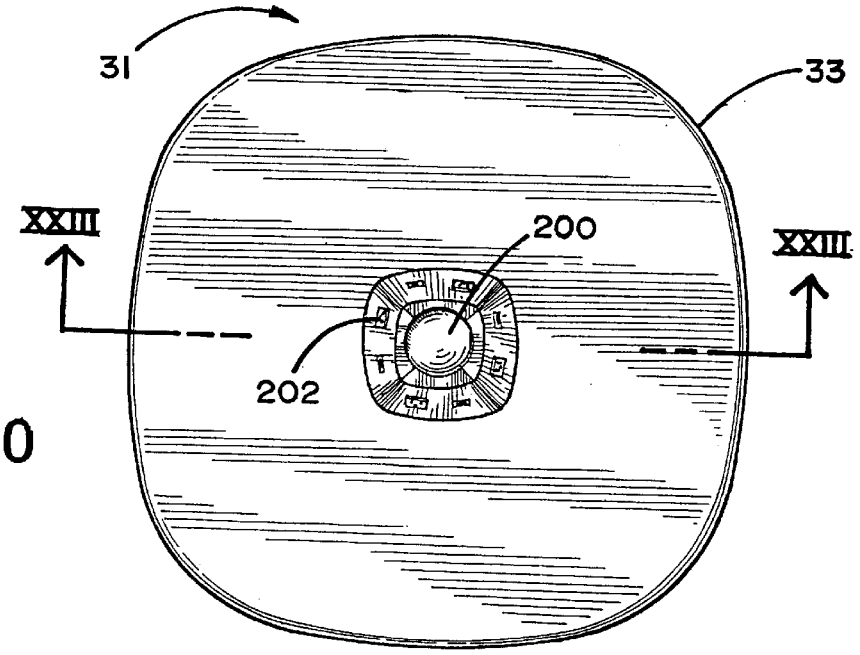
FIG. 20 is a top view of the table shown in FIG. 19.
Figure 21:
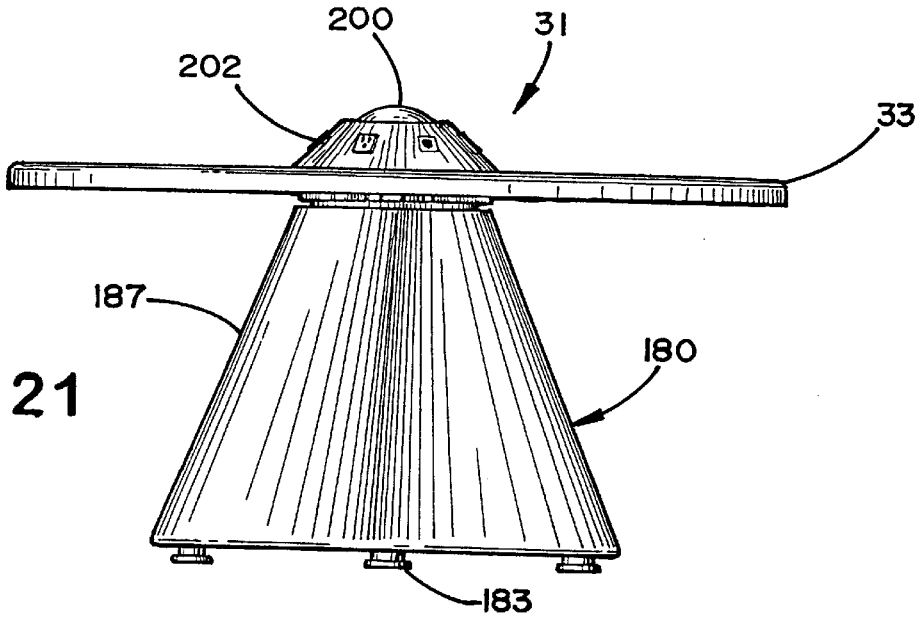
FIGS. 21 and 22 are side views of the table shown in FIG. 19, FIG. 21 showing the table top in a lowered position, and FIG. 22 showing the table in a raised position.
Figure 22:
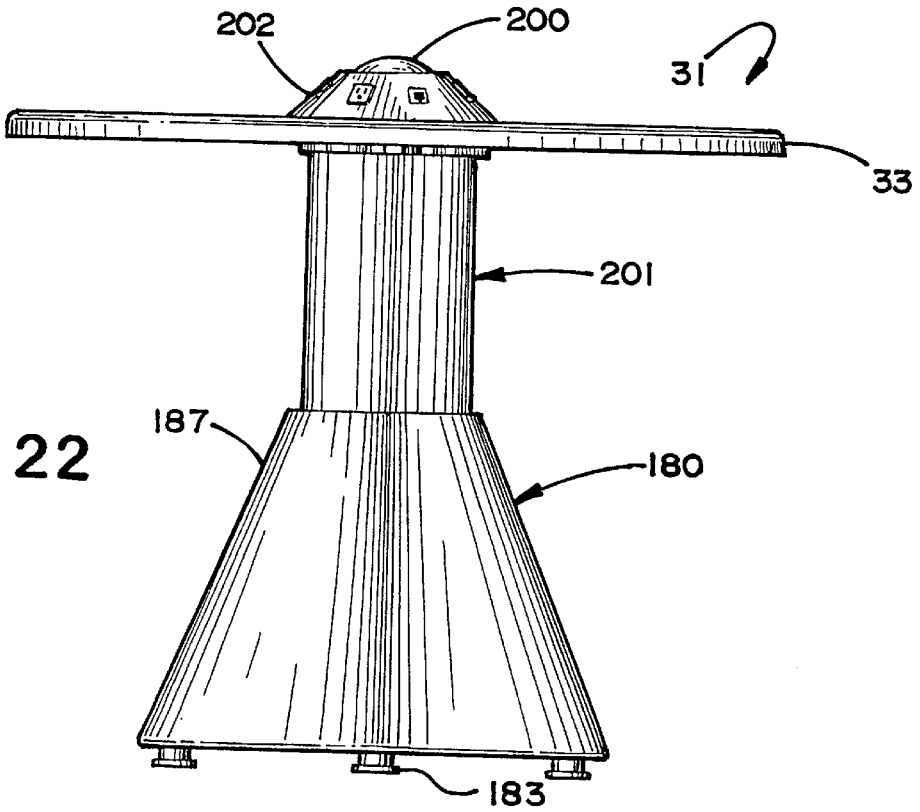

The tablet assembly 32 is stiffened by incorporating the disc-like fender washer 167A (FIG. 18) into the bolt 167. Alternatively, a tablet arm top cap 255 (FIGS. 18C–18D) is provided that replaces bolt 167 and that includes a stiffener disc portion 163A and a pivot pin portion 167A. Radial ribs 256 stiffen a circular perimeter flange 257 on disc portion 163A.

Table 31 (FIG. 24) includes a geometrically shaped base 180 and a vertically extendable table top assembly 181 including tablet top 33. Base 180 includes an X-shaped bottom frame 182 having feet 183 on the ends of its legs 184, and a center piece comprising a plate 185 for rigidity and a pocket forming cup 186. A geometrically shaped pyramid-like shell 187 is attached to bottom frame 182, and extends upwardly. The shell 187 has an open top that is generally square but with rounded corners. A gas spring or lift assist 189 includes a cylinder 190 and an extendable rod 191. The lower end of rod 191 fits mateably into the pocket of cup 186. The upper end of cylinder 190 extends above the top of shell 187. A release button 192 is located on the upper end of cylinder 190, and extends upwardly.

Figure 23:
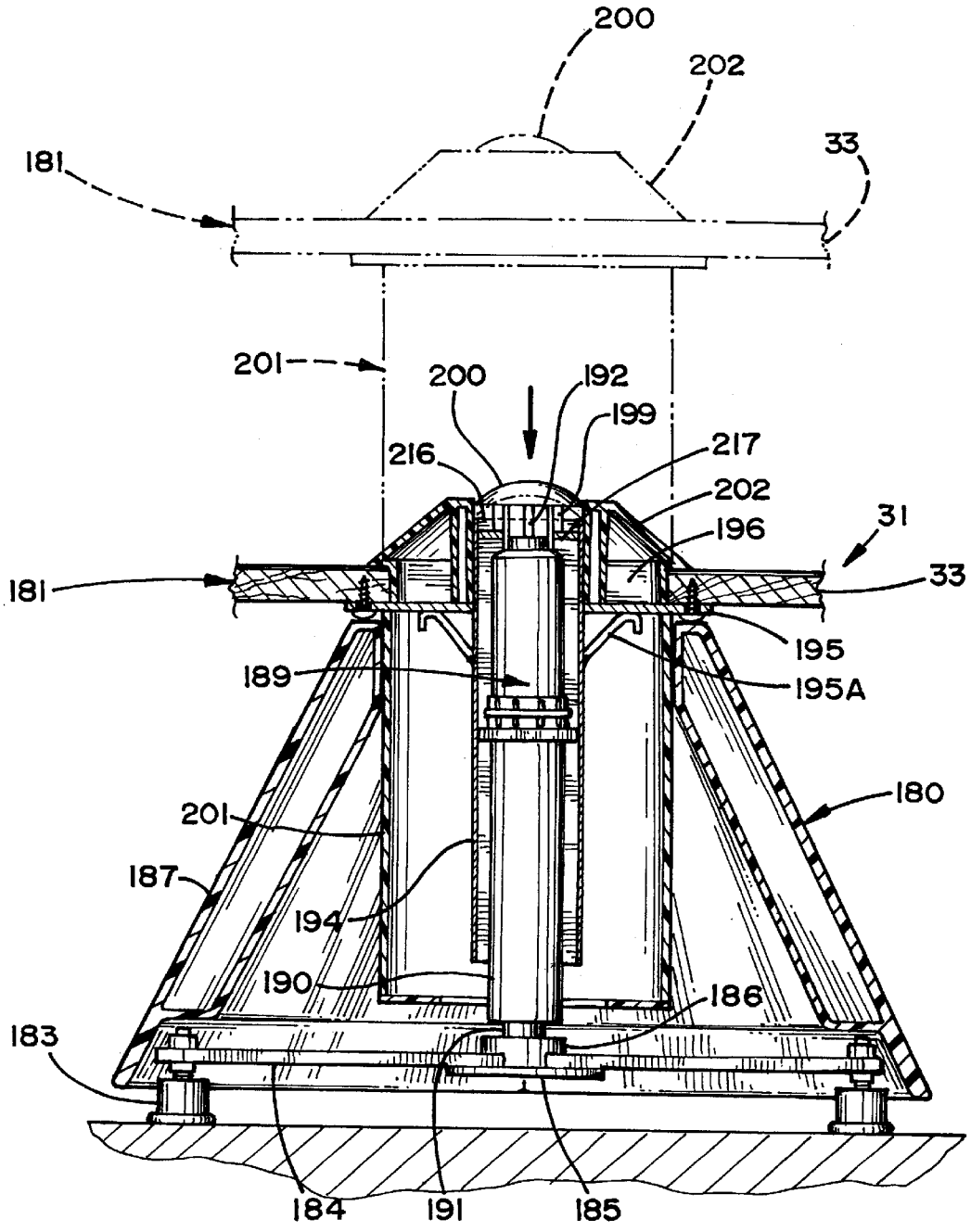
FIG. 23 is a cross sectional view taken along the plane XXIII—XXIII in FIG. 20, the table being shown in solid lines in the lowered position and in phantom lines in the raised position.

Table top assembly 181 (FIG. 24) includes a table top support 230 having a center tube 194 and having a plurality of arms 195 for supporting table top 33 that extend laterally from an upper portion of center tube 194. The illustrated arms 195 form an X-shaped pattern, although alternative shapes are contemplated. The table top 33 includes a center aperture 196 that receives an upper portion of the center tube 194, such that the table top 33 rests on the arms 195. The table top 33 is secured to arms 195 by screws or the like (FIG. 23). Notably, the table top 33 can be any of a variety of different sizes and contours. A particularly advantageous table top shape is contemplated to be a generally rectangular top with radiused corners and generously radiused long edges, the generously radiused convex long edges having a shape chosen to match the long concave edges on the tablet 32. In particular, a table top having a width somewhat greater than the long dimension of the tablet 33 is found to be particularly useful and efficient to work with.

Figure 24:
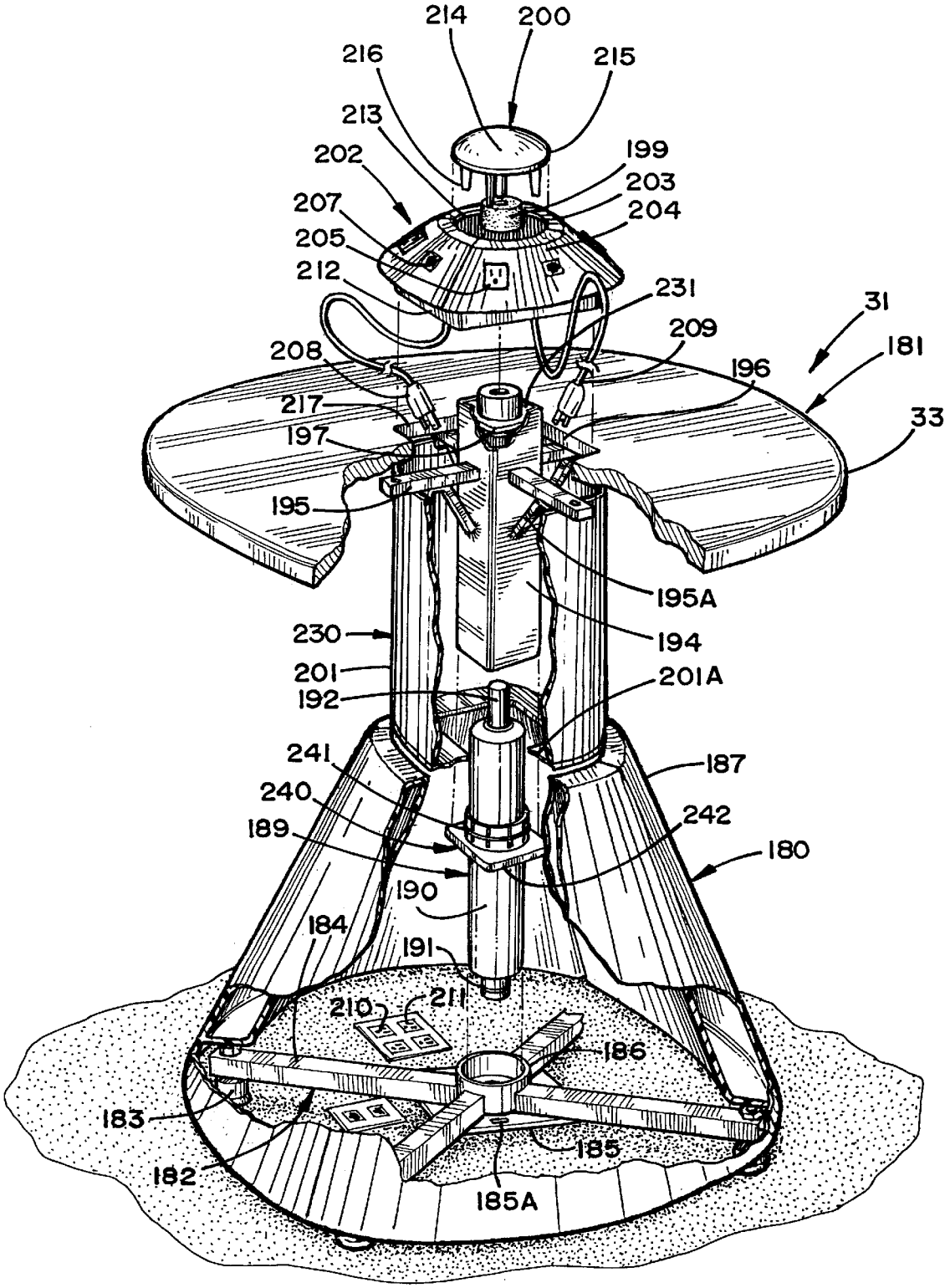
FIG. 24 is a perspective view of the table shown in FIG. 19, the table being partially broken away to expose internal components therein and being shown in a raised position.
Figure 24A:
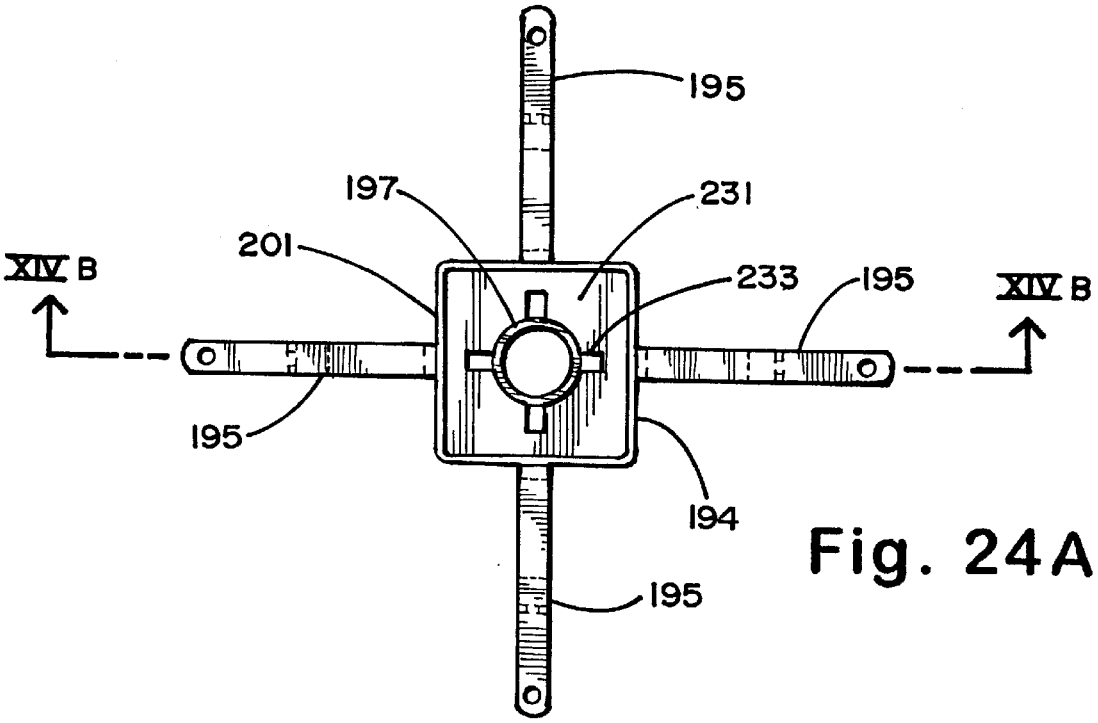
FIGS. 24A and 24B are top and side views of the table top support shown in FIG. 24, FIG. 24B being a cross sectional view taken along the line XIVB—XIVB in FIG. 24A.
Figure 24B:
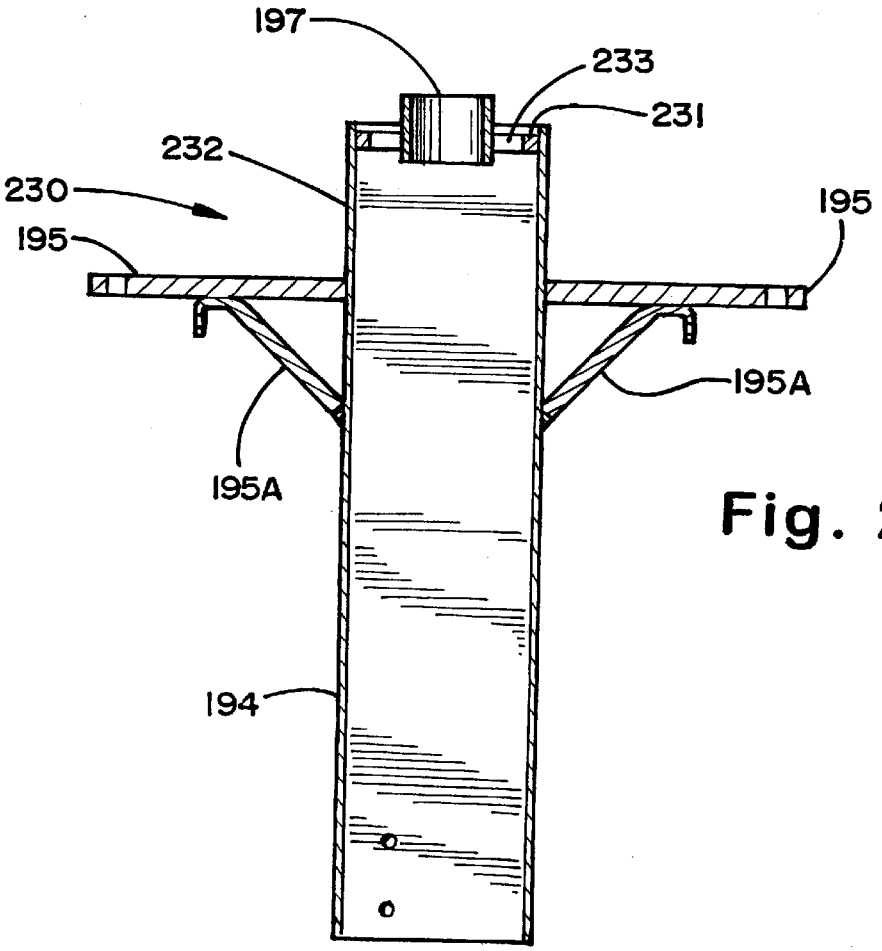

The table top support or "attachment spider" 230 (FIGS. 24A–24B) is configured stably and telescopingly supports table top 33 on base 180. Support 230 includes the center tube 194 and a ring 197 supported near a top of tube 230 in the center thereof by reinforcement plate 231. Tube 230 is adapted to telescope into the aperture at the top of base shell 187 (FIG. 24). A bushing 240 is attached to gas spring cylinder 190 by a hose clamp 241 that wraps around and tightly squeezes bushing 240 to frictionally engage bushing 240 on cylinder 190. Bushing 240 includes a rectangle plate-like lower portion 242 that slidably mateably engages an inside of rectangular tube 194 to stabilize table top assembly 181. An upper portion 232 extends above arms 195 at a height just below a top of the pyramid-shaped shell 203 (FIG. 24) of utility module 202. Plate 231 (FIG. 24B) includes slots 233 for receiving the leg/guides 216 (FIG. 24)

of actuator push button 200. Further, ring 197 is adapted to engage an upper end of actuator gas spring 189 (FIG. 24). Resilient washer 199 (such as a resilient foam) rests on ring 197 and operably positions push button 200 immediately over release button 192 of the gas spring 189.

A generally rectangular shell 201 is attached to the bottom of the arms 195 and extends downwardly telescopingly and matingly into the open upper end of the bottom shell 187. The bottom of shell 201 includes an inwardly extending flange 201A adapted to stabilize the lower part of the shell 201 to prevent undesired distortion in the shell. The inner edge of flange 201A has clearance with the cylinder 190 of gas spring 189.

A utility module 202 (FIG. 24) is adapted to cover the center aperture 196 in table top 33. The utility module 202 includes a pyramid-shaped shell 203 having four angled sides 204 that generally correspond to the sides of the table top 33. The angled sides 204 can be different or, as illustrated, can be identical. The illustrated sides 204 each include a power outlet 205, such as for powering a portable computer 206 (FIG. 28), and a telephone/communication jack 207 (FIG. 24) for operably connecting the computer 206 to a telephone line. Power and communication cables 208 and 209 extend from outlets 205 and jacks 207 for operative connection to floor outlets 210 and floor jacks 211. The location of wires 208 and cable 209 can be managed by using wire ties to attach them to slots 185A in bottom plate 185 or other clips/fingers inside of shell 201. The lower edge of the shell 203 includes a lip 212 shaped to mateably engage the marginal material forming the center aperture 196. The upper end of shell 203 defines an aperture 213 for receiving the actuator button 200. Actuator button 200 includes a flat center section 214, a downwardly extending side flange 215, and four legs 216 extending from the comers of the side flange 215. The legs 216 slidingly engage holes 217 in internal ring 197 for guiding the actuator button vertically during its operation.

To raise or lower the table top 33, a user pushes on the actuator button 200 with enough force to compress the resilient washer 199 and to cause the actuator button 200 to release the release button 192. This unlocks the extendable rod 191, which is biased toward an extended position by the gas/spring assist components in the gas cylinder 190. If the user presses downwardly with just enough force to release the release button 192, then the table top assembly 181 is litted by the force that the gas spring 189 exerts on the extendable rod 191. Contrastingly, if the user presses with a significant amount of additional downward force, the combination of the user's force and the weight of the table top assembly 181 causes the table top to be lowered. Since the actuator button 200 is in the center of the table 31 and is located in a symmetrically centered/balanced position with respect to the table top 33, the user only has to use a single hand to raise or lower the table top 33. This one-handed actuation is advantageous for several reasons. For example, adjusting the height of the table top is easily accomplished, and can be done even while the user's other hand is occupied. Also, the actuator button is easy to see and operate, and does not require fiddling to find the button and determine how it operates. Still further, even though the button is easily seen and easy to operate, the button is located in a position where it will not be accidentally operated, nor is it in the way.

Figure 27:
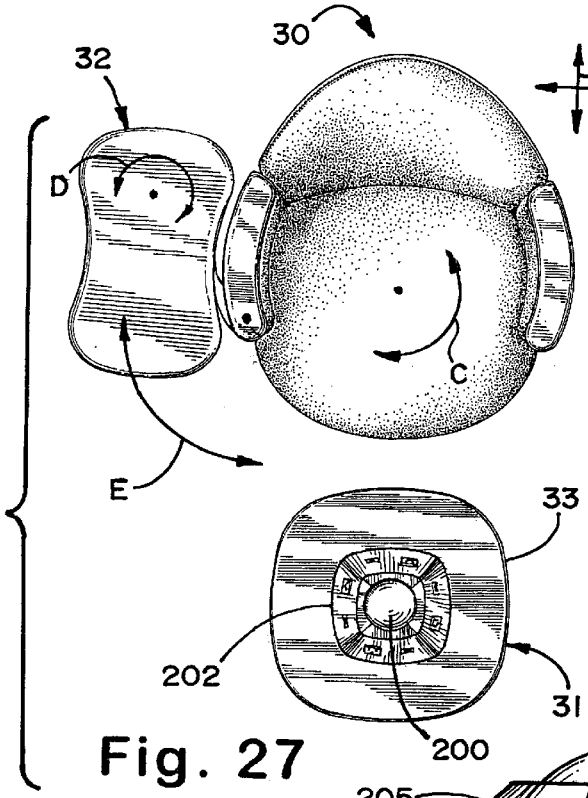
FIG. 27 is a plan view of the chair of FIG. 1 and the table of FIG. 19, the chair tablet being shown in a side position.
Figure 28:
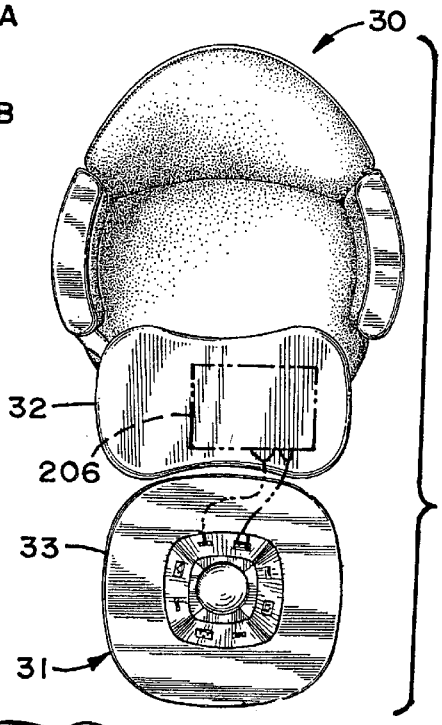
FIG. 28 is a plan view comparable to FIG. 27, but with the chair tablet being positioned adjacent and against the table top.
Figure 25:
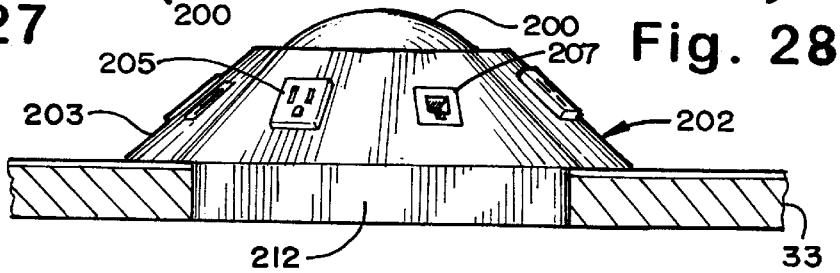
FIGS. 25 and 26 are side and top views of the utility module positioned in a center of the table top, FIG. 25 showing fragmentary portions of the table top that engage the utility module.
Figure 26:
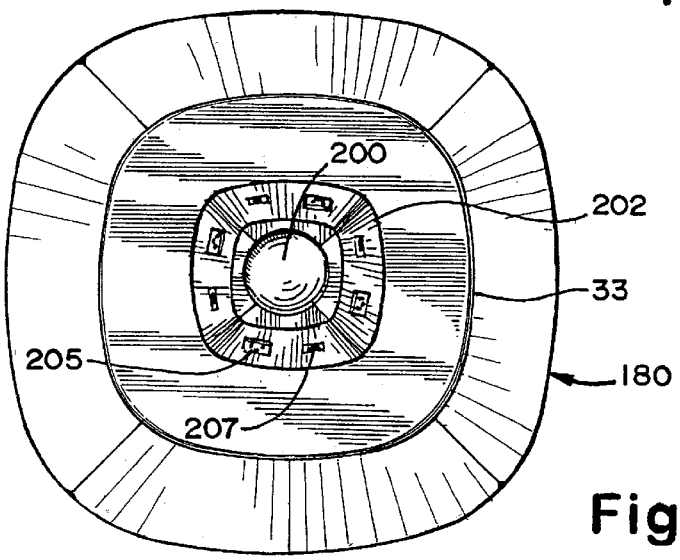

The cooperation of the chair 30 (or 30A or 30B) and the table 31 (or table 31A) is shown in FIGS. 27 and 28. The chair 30 is readily moveable in a variety of directions, including linear directions A and B, but also rotationally in direction C. Also, the tablet is moveable in a variety of directions, including rotationally about a first axis in direction D and rotationally about a second axis in direction E. The rotational movements D and E allow the tablet 32 to be articulated to a wide variety of positions, which positions accommodate the many different positions desired by computer users. If the user desires a larger/deeper work area, the table top 33 can be adjusted to an equal height with the tablet 32 and the table 31 can be positioned in front of the chair 30 with the tablet 32 abutting against a front edge of the table top 33 (FIG. 28). If the user desires a larger/wider work area, the tablet 32 can be rotated so that its long dimension extends forwardly generally in front of the chair armrest. Then, the table 31 is positioned generally beside the tablet 32 and in front of the chair 30. Another alternative is for a user to adjust the height of the table so that the table top is slightly below the tablet height. This allows the tablet 32 to be positioned closer to or even slightly over the table top 33. Still another possibility is for two users to move a pair of chairs 30 together in a side-by-side arrangement, with the tablet 32 located between the two chairs. In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. An article of furniture comprising:

a chair;

a tablet;

support arm operably attached to the tablet and to the chair for operably supporting the tablet on the chair for articulated movement between at least one horizontal use position generally in front of the chair, and a horizontal side position beside the chair, the support arm further supporting the tablet for movement between the horizontal side position and a vertical storage position located generally below the horizontal side position; and a latch operable when the tablet is in the horizontal side position for releasing the tablet from the horizontal side position to the vertical storage position, but which is inoperable in the at least one horizontal use position.

2. The article defined in claim 1, including a latch handle operably connected to the latch, and a track on the tablet, the latch handle engaging the track to prevent operation of the latch except when the latch handle has a predetermined orientation with respect to the track.

3. The article defined in claim 1, wherein the chair includes right and left armrests, and the support arm is configured to be attached to either the right armrest or the left armrest.

4. The article defined in claim 1 wherein the support arm is pivoted to the chair on one end and pivoted to the tablet on its other end.

5. The article defined in claim 1 wherein the support arm includes a bent rod weldment for pivotally engaging an armrest of the chair, and further includes a pivot member rotatably engaging the weldment and also pivotally engaging the tablet.

6. The article defined in claim 5 wherein the latch is operably mounted on the pivot member and includes a slidable rod for releasably engaging the bent rod weldment.

7. An article of furniture comprising:

a chair;

a support arm having a first end pivoted to the chair at a first pivot and a second end;

a tablet including a support panel pivoted to the second end at a second pivot, said tablet including a replaceable top panel secured to the support panel for providing a replaceable writing surface on the support panel; and a latch slidably mounted to said first pivot for releasing the tablet for movement from a horizontal side position to a vertical storage position.

8. The article defined in claim 7, wherein said tablet includes a marginal edge having a pair of opposing elongated concave edges and a pair of opposing shorter convex edges joining the concave edges.

9. The article defined in claim 7 wherein said replaceable top panel includes bosses adapted to receive threaded ends of attachment screws, and said support panel includes holes corresponding to said bosses for receiving shafts of the attachment screws.

10. The article defined in claim 7 wherein said support arm includes a rod weldment pivoted to said chair, and further includes a pivot member pivoted to said rod weldment at one end and to said support panel at another end, said pivot member including said first pivot.

11. The article defined in claim 7 including a pivot on said support panel including a pivot pin and a pair of disks sandwiched about the support panel for reinforcing said pivot.

12. The article defined in claim 11 wherein said replaceable top panel includes bosses adapted to receive threaded ends of attachment screws, and said support panel includes holes corresponding to said bosses for receiving shafts of the attachment screws, said pivot pin extending through the support panel but not through the replaceable top panel.

13. The article defined in claim 7 wherein said replaceable top panel includes an inlay of scratch resistant material.

14. The article defined in claim 13 wherein said scratch resistant material is a polymeric material.

15. An article of furniture comprising:

a chair;

a support arm having a first end pivoted to the chair at a first pivot and a second end, a tablet including a support panel pivoted to the second end at a second pivot, said tablet including a replaceable top panel secured to the support panel for providing a replaceable writing surface on the support panel;

a support arm including a rod weldment pivoted to said chair, and further includes a pivot member pivoted to said rod weldment at one end and to said support panel at another end, said pivot member including said first pivot; and a latch slidably mounted to said pivot member for releasably engaging the rod weldment.

16. The article defined in claim 15 wherein the latch includes a handle, and wherein the support panel includes a ridge engaging the handle to prevent operation of the latch unless the support arm has a predetermined orientation with respect to the tablet.

17. A chair comprising:

a lounge-type seat assembly including a circular bottom frame and a skirt draping downwardly from the bottom frame;

a base including radially extending legs and floor-engaging casters supported on ends of the legs; and a pivot rotatably supporting the seat assembly on the base with the legs and castors being visually shielded by the skirt.

18. The chair defined in claim 17 including a tablet attached to the seat assembly and supported thereon by a support for articulated motion between a plurality of horizontal use positions generally in front of the chair.

19. The claim defined in claim 17 including a support arm having a first end pivoted to the chair at a first pivot and a second end; and a tablet including a support panel pivoted to the second end at a second pivot, whereby the tablet is moveable between a plurality of horizontal use positions relative to the chair.

20. The chair defined in claim 19 including a storage area under the seat assembly and including a shelf located in the storage area.

21. The chair defined in claim 17 wherein the bottom frame includes a structural ring that extends around a lower perimeter of the seat assembly proximate but spaced from a floor surface supporting the chair.

22. The chair defined in claim 21 including a semi-cylindrically-shaped back shell attached to the structural ring.

23. The chair defined in claim 22 including armrest shells attached to the structural ring on opposing, sides of the back shell.

24. The defined in claim 22 including a shelf attached to the back shell at a location spaced above the structural ring.

* * * * *

UNITED STATES PATENT AND TRADEMARK OFFICE

CERTIFICATE OF CORRECTION

PATENT NO. : 5,816,649
DATED : October 6, 1998
INVENTOR : Michael R. Shields

It is certified that error appears in the above-identified patent and that said Letters Patent is hereby corrected as shown below:

Column 1, line 14;

"08/064,102" should be --29/064,102--.

Column 12, claim 19, line 26;

"The claim" should be --The chair--.

Column 12, claim 24, line 46;

Before "defined" insert --chair--.

Signed and Sealed this

Twenty-fifth Day of May, 1999

*Attest:*

Q. TODD DICKINSON

*Attesting Officer*

*Acting Commissioner of Patents and Trademarks*